US010829881B2

(12) United States Patent
Choi

(10) Patent No.: US 10,829,881 B2
(45) Date of Patent: Nov. 10, 2020

(54) DOOR LOCK DEVICE FOR WASHING MACHINE AND METHOD OF LOCKING WASHING MACHINE DOOR

(71) Applicant: SCD CO., LTD., Yongin-si (KR)

(72) Inventor: Jae Hyoung Choi, Yongin-si (KR)

(73) Assignee: SCD CO., LTD., Yongin-si (KR)

( * ) Notice: Subject to any disclaimer, the term of this patent is extended or adjusted under 35 U.S.C. 154(b) by 849 days.

(21) Appl. No.: 15/356,708

(22) Filed: Nov. 21, 2016

(65) Prior Publication Data

US 2017/0145613 A1 May 25, 2017

(30) Foreign Application Priority Data

Nov. 23, 2015 (KR) ..... 10-2015-0163932

(51) Int. Cl.
*D06F 37/10* (2006.01)
*D06F 39/14* (2006.01)
(Continued)

(52) U.S. Cl.
CPC ..... *D06F 37/10* (2013.01); *D06F 39/14* (2013.01); *E05B 17/2007* (2013.01);
(Continued)

(58) Field of Classification Search
CPC ..... E05B 17/2007; E05B 47/0603; E05B 47/0012; E05B 2047/002; Y10T 292/1089; Y10T 292/1091; Y10T 292/1084; Y10T 292/696; Y10T 292/702; Y10T 292/1001; Y10S 292/04; Y10S 292/69; D06F 37/10; D06F 39/14; D06F 37/42; E05C 19/022
(Continued)

(56) References Cited

U.S. PATENT DOCUMENTS 5,072,974 A * 12/1991 Henne ..... E05C 19/022 292/126
5,090,751 A * 2/1992 Kobayashi ..... B60N 3/08 292/210
(Continued)

FOREIGN PATENT DOCUMENTS

CN 102094305 A 6/2011
CN 103573048 A 2/2014
(Continued)

*Primary Examiner* — Carlos Lugo
*Assistant Examiner* — Faria F Ahmad
(74) *Attorney, Agent, or Firm* — Rabin & Berdo, P.C.

(57) ABSTRACT

The present disclosure provides a door lock device for releasably locking a door of a washing machine. The door lock device has first to third latches, and a drive motor and a latch drive mechanism for moving the third latch. The first latch releasably locks the door of the washing machine and is movable in frontward and rearward directions. The movement of the first latch is changed at a change position. The first latch is always biased frontward by a spring. The second latch releasably locks the first latch, which locks the door of the washing machine, at a door locking position. The third latch is moved in a direction perpendicular to the movement direction of the first latch. The third latch restricts the first latch at the door locking position, or unlocks the first latch after pushing the first latch from the door locking position against the spring.

13 Claims, 25 Drawing Sheets

(51) Int. Cl.

| | |
|---|---|
| ***E05B 17/20*** | (2006.01) |
| ***E05B 47/06*** | (2006.01) |
| ***E05C 19/02*** | (2006.01) |
| ***D06F 37/42*** | (2006.01) |
| ***E05B 47/00*** | (2006.01) |

(52) U.S. Cl.
CPC ..... *E05B 47/0603* (2013.01); *E05C 19/022* (2013.01); *D06F 37/42* (2013.01); *E05B 47/0012* (2013.01); *E05B 2047/002* (2013.01); *Y10S 292/04* (2013.01); *Y10S 292/69* (2013.01); *Y10T 292/1001* (2015.04); *Y10T 292/1084* (2015.04); *Y10T 292/1089* (2015.04); *Y10T 292/1091* (2015.04); *Y10T 292/696* (2015.04); *Y10T 292/702* (2015.04)

(58) Field of Classification Search
USPC ..... 292/DIG. 4, DIG. 69
See application file for complete search history.

(56) References Cited

U.S. PATENT DOCUMENTS 5,401,067 A * 3/1995 Kurosaki ..... E05C 5/00 292/63
5,473,922 A * 12/1995 Bair ..... E05B 47/0012 292/144
5,487,289 A * 1/1996 Otto, III ..... E05B 47/0002 292/150
5,493,099 A * 2/1996 McWilliams, III ..... E05B 51/02 126/197
5,498,039 A * 3/1996 Bivens ..... B60N 3/08 292/145
5,520,424 A * 5/1996 Hapke ..... D06F 37/42 292/198
5,592,838 A * 1/1997 Clark ..... E05B 37/00 292/251.5
5,984,381 A * 11/1999 Yamagishi ..... E05C 19/022 267/158
5,997,056 A * 12/1999 Yamagishi ..... E05C 19/022 292/341.17
6,315,336 B1 * 11/2001 Swartzell ..... E05B 47/0012 292/201
6,318,771 B1 * 11/2001 Holloway ..... B60K 15/05 292/201
6,869,114 B2 * 3/2005 Ueki ..... E05C 19/022 292/341.17
6,886,869 B2 * 5/2005 Martinez ..... E05B 17/0029 292/129
7,032,936 B2 * 4/2006 Promutico ..... D06F 37/42 292/341.17
7,036,853 B2 * 5/2006 Smock ..... E05B 17/0029 292/109
7,165,790 B2 * 1/2007 Bella ..... E05C 19/022 292/302
7,278,664 B2 * 10/2007 Su ..... E05C 19/022 292/304
7,393,026 B2 * 7/2008 Ikeda ..... E05C 19/02 292/341.15
7,455,334 B2 * 11/2008 Hisatomi ..... E05C 19/022 292/80
7,503,722 B2 * 3/2009 Chou ..... A45F 5/00 292/333
7,549,685 B2 * 6/2009 Mueller ..... D06F 37/42 292/251.5
8,276,951 B2 * 10/2012 Dirnberger ..... A47L 15/4259 292/216
8,376,418 B2 * 2/2013 Osvatic ..... D06F 37/42 292/198
8,393,651 B2 * 3/2013 Suzuki ..... E05B 77/06 292/1
8,973,956 B2 * 3/2015 Sambommatsu ..... E05C 19/022 292/341.15
2002/0062670 A1 * 5/2002 Doong ..... E05B 47/0012 70/279.1
2003/0160461 A1 * 8/2003 Promutico ..... D06F 37/42 292/216
2007/0039810 A1 * 2/2007 Chou ..... E05C 19/022 200/329
2014/0239646 A1 * 8/2014 Betzen ..... E05B 81/40 292/139
2014/0312627 A1 * 10/2014 Frommann ..... E05B 83/34 292/57
2015/0240527 A1 8/2015 Osvatic et al.
2016/0047148 A1 * 2/2016 Aker ..... E05B 47/0603 292/220
2016/0208520 A1 * 7/2016 Jordan ..... E05B 47/0607
2016/0251881 A1 * 9/2016 Dirnberger ..... E05B 47/0603 292/195
2017/0362766 A1 * 12/2017 Cho ..... D06F 37/28
2018/0008120 A1 * 1/2018 Dirnberger ..... E05C 3/14
2018/0029469 A1 * 2/2018 Persiani ..... B60K 15/05
2018/0266151 A1 * 9/2018 Sonobe ..... B60K 15/05
2019/0040654 A1 * 2/2019 Dirnberger ..... D06F 37/30
2019/0071895 A1 * 3/2019 Raz ..... E05B 47/0012

FOREIGN PATENT DOCUMENTS

CN 104662219 A 5/2015
GB 2516950 A 2/2015
KR 10-2012-0122777 A 11/2012

* cited by examiner

DOOR LOCK DEVICE FOR WASHING MACHINE AND METHOD OF LOCKING WASHING MACHINE DOOR

CROSS-REFERENCE TO RELATED APPLICATIONS

This application claims the benefit of Korean Patent Application No. 10-2015-0163932, filed on Nov. 23, 2015, in the Korean Intellectual Property Office, the disclosure of which is incorporated herein in its entirety by reference.

TECHNICAL FIELD

The present disclosure relates to a device and method of releasably locking a door of a washing machine.

BACKGROUND

A door of a drum washing machine is rotatably coupled to the front of the washing machine so as to close an opening communicating with a washing tank. It is important that the door of the drum washing machine must be designed so as not to be opened during a washing operation. To this end, the drum washing machine is provided with a door lock device which locks the door during the washing operation. By way of example, Korean patent application publication No. 2012-0122777 discloses an example of such a door lock device for a washing machine.

The door lock device for a washing machine may be provided in the door of the washing machine or in a housing of the washing machine in the vicinity of the door of the washing machine. In case the door lock device is provided in a door of the drum washing machine, it is important that the door lock device must have a compact structure because of the narrow installation space inside the door of the drum washing machine. However, the door lock device of a prior art does not have a sufficiently compact structure.

Further, the door lock device of a prior art has a single latch. Thus, to realize various operation modes in connection with releasably locking the door of the drum washing machine, the door of the drum washing machine must be provided with a plurality of the door lock devices. This limits the design of the door of the drum washing machine, when considering the narrow installation space inside the door of the drum washing machine.

After a certain time from the end of the washing operation, the user opens a washing machine door and takes out laundry from a washing tank. During said certain time, the washing tank is closed by the washing machine door, and therefore the laundry inside the washing tank may go sour due to moisture. However, since the door lock device of a prior art has only a structure for unlocking the door, the washing machine door can remain unlocked during said certain time after the end of the washing operation. That is, the door lock device of a prior art is designed without consideration of quality maintenance of the laundry.

SUMMARY

Embodiments of the present disclosure solve the aforementioned problems of the prior art. Some embodiments of the present disclosure provide a door lock device for a washing machine, which includes a structure releasably locking a door and a structure pushing the unlocked door.

One aspect of the present disclosure provides a door lock device for a washing machine, which is provided in the door of the washing machine or in a housing of the washing machine in the vicinity of the door of the washing machine. A door lock device according to an exemplary embodiment includes: a housing; a first latch movably coupled to the housing; a spring disposed in the housing; a second latch; a third latch movably disposed in the housing; a drive motor disposed in the housing and driving the third latch; and a latch drive mechanism operably coupled to the housing and moving the third latch. The first latch is coupled to the housing to be movable in frontward and rearward directions. The first latch is movable to a door unlocking position where the first latch unlocks the door, a change position located rearward from the door unlocking position, and a door locking position which is located between the door unlocking position and the change position and at which the first latch locks the door. The spring biases the first latch toward the door unlocking position. The second latch releasably locks the first latch at the door locking position. The third latch releasably locks the first latch. The third latch restricts the first latch at the door locking position, and unlocks the first latch after pushing the first latch from the door locking position to the change position against the spring.

In an embodiment, the drive motor and the latch drive mechanism move the third latch to a latch unlocking position where the first latch is unlocked, a latch restricting position where the first latch is restricted at the door locking position, and a latch moving position where the first latch is pushed from the door locking position toward the change position against the spring.

In an embodiment, the latch unlocking position, the latch restricting position and the latch moving position are located in line. The drive motor and the latch drive mechanism change a movement of the third latch between the latch restricting position and the latch moving position.

Further, the latch moving position may include a first latch moving position where the first latch is moved from the door locking position toward the change position and a second latch moving position where the first latch is positioned from the door locking position to the change position. In such an example, the drive motor and the latch drive mechanism may change the movement of the third latch between the latch restricting position and the second latch moving position. The second latch moving position may be located between the first latch moving position and the latch unlocking position.

In an embodiment, the door lock device further includes at least one detection switch for detecting a movement of the third latch toward the latch restricting position. Further, the third latch includes a switch activating portion which makes contact with the detection switch and activates the detection switch.

In an embodiment, one of the first latch and the third latch includes a lock pin, and the other of the first latch and the third latch includes a pin groove to which the lock pins is inserted. A movement of the third latch pushes the first latch toward the change position through contact between the lock pin and the pin groove.

In an embodiment, the pin groove includes a latch restricting groove and a latch moving groove which extends from the latch restricting groove and is inclined with respect to the latch restricting groove. The lock pin is positioned at the latch restricting groove, restricting the first latch at the door locking position. The lock pin is moved along at least a portion of the latch moving groove, pushing the first latch toward the change position.

The pin groove may include a guide surface guiding the lock pin from the latch restricting groove to the latch moving groove. The latch restricting groove may extend perpendicularly to a movement direction of the first latch. The pin groove may have a V-like shape or a U-like shape.

In an embodiment, the first latch includes the pin groove and the third latch includes the lock pin. The housing includes a guide slit extending obliquely with respect to a movement direction of the first latch. The lock pin is inserted to the pin groove through the guide slit.

In an embodiment, the third latch includes a slider coupled to the housing to be obliquely slidable with respect to a movement direction of the first latch, and a rack gear coupled to the slider. The lock pin is coupled to the slider. The latch drive mechanism includes at least one pinion gear which is meshed with the rack gear and moves the third latch.

The pinion gear may include a toothless section in a portion of a perimeter and a stopper in the toothless section. The rack gear may include a toothless section which enters into the toothless section of the pinion gear at the latch restricting position. The stopper is positioned at the toothless section of the rack gear and may fix the slider at the latch restricting position. A gear tooth of the rack gear in the toothless section of the rack gear may have a thickness at which the gear tooth does not make contact with the stopper. Gear teeth of the rack gear located at both ends of the toothless section of the rack gear may make contact with the stopper.

In such an embodiment, the slider includes an arm biasing the lock pin toward the pin groove.

Another aspect of the present disclosure provides a door locking method for automatically unlocking a door of a washing machine after an end of a washing operation. A door locking method according to an exemplary embodiment releasably locks the door of the washing machine by using a first latch, a spring and a second latch. The first latch is movable to a door unlocking position where the door is unlocked, a change position located rearward from the door unlocking position, and a door locking position which is located between the door unlocking position and the change position and at which the door is locked. The spring biases the first latch toward the door unlocking position. The second latch releasably locks the first latch at the door locking position. According to the door locking method of the exemplary embodiment, the door of the washing machine is releasably locked by providing the first latch, the spring and the second latch with a third latch which is moved in a direction different from a movement direction of the first latch and releasably locks the first latch. The first latch is restricted at the door locking position by the third latch. The first latch is pushed by the third latch toward the change position against the spring such that the second latch unlocks the first latch. The first latch is unlocked from the third latch. The first latch is moved toward the door unlocking position by the spring. In an embodiment, when the first latch is pushed by the third latch toward the change position against the spring, the first latch is unlocked from the second latch and the first latch is positioned at the change position.

The door lock device according to one embodiment locks the washing machine door by means of the first latch and the second latch through one-time pressing on the first latch, and unlocks the washing machine door through another one-time pressing on the first latch. Further, since the third latch restricts the first latch at the door locking position, the washing machine door remains locked during a washing operation. Further, since the third latch unlocks the first latch after the end of the washing operation, the door lock device according to one embodiment is capable of pushing the washing machine door. Further, since a structure for releasably locking and pushing the washing machine door is compactly arranged in the housing, the door lock device according to one embodiment does not limit an inside design of the washing machine door.

DETAILED DESCRIPTION

Figure 1:
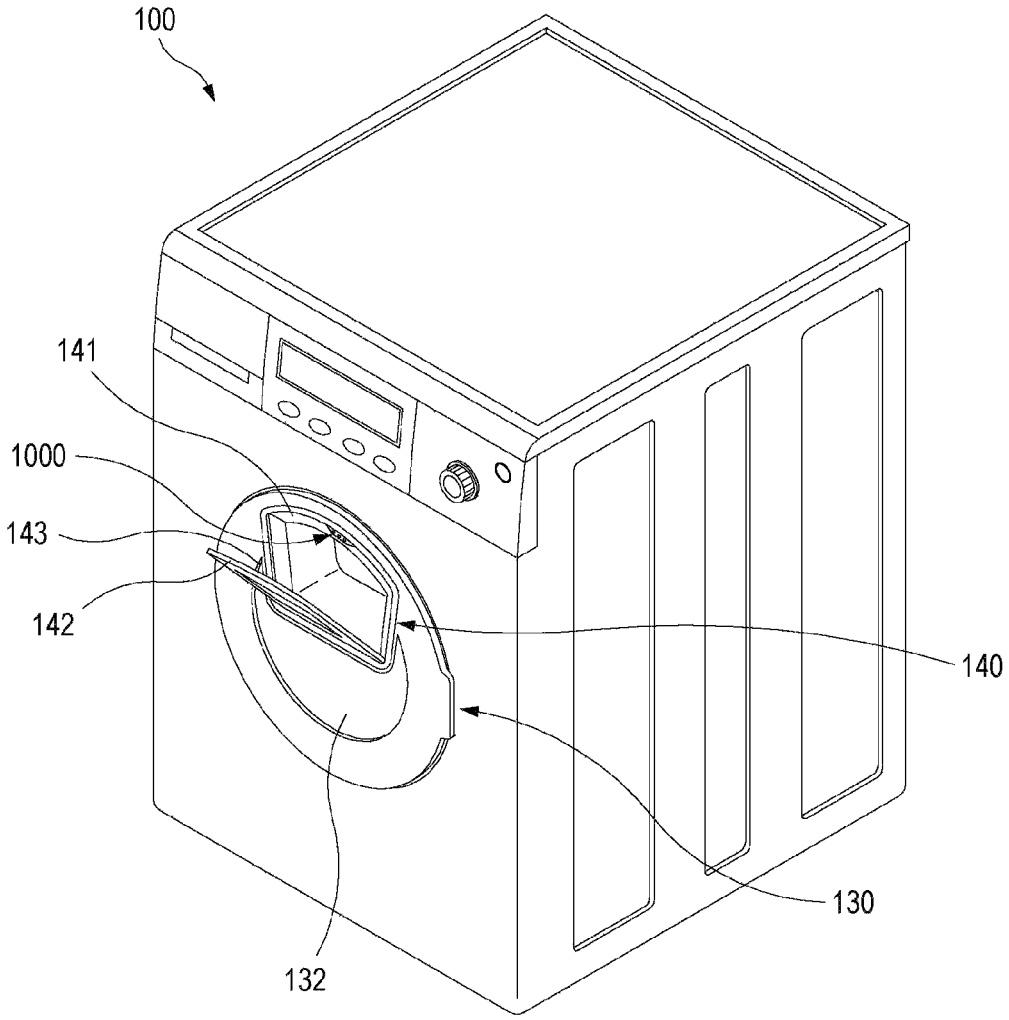
FIG. 1 is a perspective view showing a drum washing machine to which a door lock device according to one embodiment can be applied.

Descriptions are made as to embodiments of a door lock device for a washing machine with reference to the accompanying drawings. In the drawings, like reference numerals denote like or corresponding elements or parts. The directional term "frontward," "front" or the like as used herein is based on a direction in which a door for opening and closing a washing tank is positioned with respect to a center of a washing machine, while the directional term "rearward," "rear" or the like as used herein means a direction opposite to the frontward or front direction.

Figure 2:
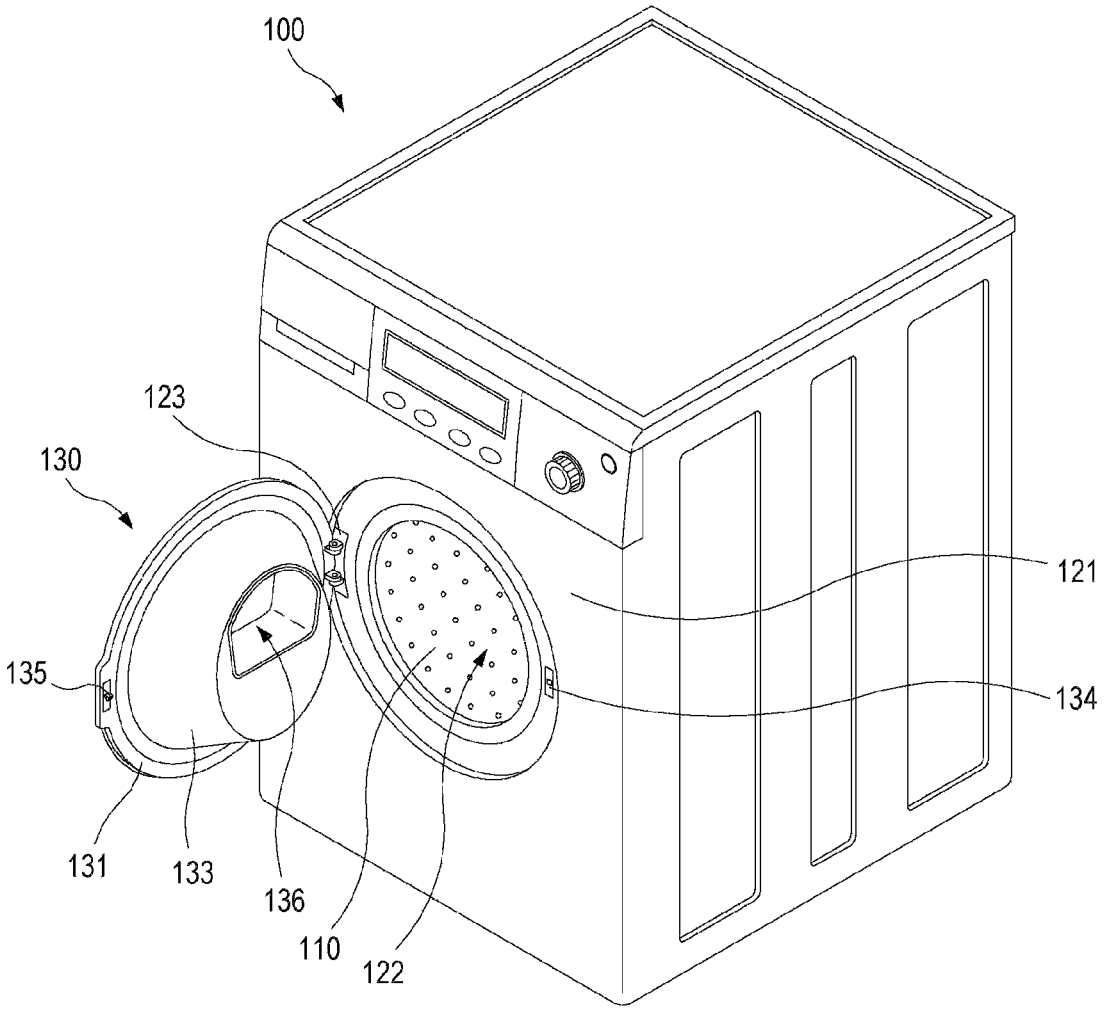
FIG. 2 is a perspective view showing the drum washing machine shown in FIG. 1, a door of which is open.

FIGS. 1 and 2 show an example of a washing machine to which a door lock device according to one embodiment can be applied. The washing machine shown in FIGS. 1 and 2 may be referred to as a drum washing machine in the art.

Referring to FIGS. 1 and 2, the washing machine 100 includes: a drum-shaped washing tank 110; a circular opening 122 located at a front portion 121; a main door 130 rotatably attached to the front portion 121; and a sub-door 140 rotatably attached to the main door 130. The washing tank 110 receives laundry and is rotated around an axis parallel to the ground. The laundry may be put in and taken out through the opening 122. The main door 130 opens and closes the opening 122.

The main door 130 includes a circular door frame 131, a front door cover 132 located at a front side of the door frame 131 and made of a translucent material, and a rear door cover 133 located at a rear side of the door frame 131 and made of a transparent or translucent material. The rear door cover 133 protrudes rearward. The main door 130 is rotatably attached to the front portion 121 of the washing machine 100 through a door hinge 123 provided at a lateral side of the opening 122. The front portion 121 of the washing machine is provided with a door key 134 of the main door 130 which is located opposite the door hinge 123. An edge of the door frame 131 is provided with a door lock device 135 which is releasably coupled to the door key 134. If the main door 130 closes the opening 122 and the door key 134 and the door lock device 135 are coupled to each other, the main door 130 closes the opening 122 such that washing water does not leak.

The washing machine 100 includes the sub-door 140 which is used for putting additional laundry into the washing tank 110 or taking out the laundry from washing tank 110 when the opening 122 is closed by the main door 130. The sub-door 140 is located in the main door 130. A sub-opening 136 is penetrated through the main door 130 to permit access to the washing tank 110. The sub-door 140 is attached to the main door 130 to open and close the sub-opening 136.

The sub-door 140 has a sub-door frame 141, which forms a front portion of the sub-opening 136, and a sub-door cover 142 which is rotatably attached to the sub-door frame 141. The sub-door frame 141 has a generally quadrilateral shape. The sub-door cover 142 is rotatable frontward and rearward with respect to the sub-door frame 141 through a sub-door hinge which is provided at a lower side portion of the sub-door frame 141 and a lower end of the sub-door cover 142. The sub-door cover 142 is rotated rearward to close the sub-opening 136, and is rotated frontward at a predetermined angle to open the sub-opening 136.

A door lock device 1000 according to one embodiment is disposed at an upper side portion of the sub-door frame 141. A door key 143 protrudes at an upper end of the sub-door cover 142.

Descriptions are made as to one embodiment of a door lock device with reference to FIGS. 3 to 32. The door lock device 1000 according to one embodiment releasably locks the sub-door 140 through engagement with or disengagement from the door key 143 of the sub-door 140 of the washing machine 100. The door lock device 1000 according to one embodiment may be used so as to releasably lock the main door 130 of the washing machine 100. Further, the door lock device 1000 according to one embodiment may be used so as to releasably lock a door of a pulsator type or agitator type washing machine other than a drum washing machine.

The door lock device 1000 includes a first latch 1200 releasably locking the door key 143 of the sub-door 140, a second latch 1300 releasably locking the first latch 1200, and a third latch 1400 releasably locking the first latch 1200 which locks the door key 143. The first latch 1200, the second latch 1300 and the third latch 1400 are disposed in a housing 1100 which forms an outer shell of the door lock device 1000 and serves as a frame of the door lock device 1000.

The first latch 1200 is movable in a frontward direction FD (i.e., in a direction of opening the sub-door 140) and in a rearward direction RD (i.e., in a direction of closing the sub-door 140). Further, a spring 1230 disposed in the housing 1100 always biases the first latch 1200 frontward. The second latch 1300 is rotatable within a predetermined range. The first latch 1200 and the second latch 1300 lock the door key 143 in response to the user's pressing the sub-door one time. Further, the first latch 1200 and the second latch 1300 unlock the door key 143 in response to the user's pressing the sub-door a second time. Regarding such actions of the first latch 1200 and the second latch 1300, the first latch 1200 is movable to a door unlocking position DUP (see FIGS. 14 and 28), a change position CP (see FIG. 27) and a door locking position DLP (see FIGS. 15 and 25). In the door unlocking position DUP, the first latch 1200 unlocks the sub-door 140. The change position CP is located rearward from the door unlocking position DUP. The movement of the first latch 1200 is changed in the change position CP. That is, in the change position CP, the rearward movement of the first latch 1200 is changed into the frontward movement. In the door locking position DLP, the first latch 1200 is coupled to the door key 143 and is locked by the second latch 1300, thereby locking the sub-door 140. Specifically, the first latch 1200 is moved from the door unlocking position DUP to the change position CP and thereafter from the change position CP to the door locking position DLP, or is moved in a sequence reverse to the aforementioned sequence. The door locking position DLP is located closely to the change position CP between the door unlocking position DUP and the change position CP. During the aforementioned movement of the first latch 1200, the first latch 1200 is always biased toward the door unlocking position DUP (i.e., frontward) by the spring 1230.

In the housing 1100, the door lock device 1000 includes an electric drive source for driving the third latch 1400, and a latch drive mechanism operably coupled to the electric drive source and moving the third latch 1400. By virtue of the drive source and the latch drive mechanism, the third latch 1400 is driven (actuated or moved) in a direction different from the frontward direction FD and the rearward direction RD which are the movement directions of the first latch 1200. With the actuation or movement of the third latch 1400, the first latch 1200 is pushed against the force of the spring 1230 from the door locking position DLP to the change position CP and is then positioned at the change position CP and thereafter is unlocked from the third latch 1400. Further, the door lock device 1000 includes a detector 1700 for detecting the movement of the third latch 1400. The electric power supply to the aforementioned drive source, the transmission of signals generated by the detector 1700, etc. are performed through connectors 1811 and 1812 attached to the housing 1100.

The housing 1100 houses the aforementioned latches, drive source and latch drive mechanism therein. The housing 1100 is attached to a washing machine. Specifically, the housing 1100 may be attached to the inside of a door of a washing machine, or a housing of a washing machine in the vicinity of a door of a washing machine.

Figure 3:
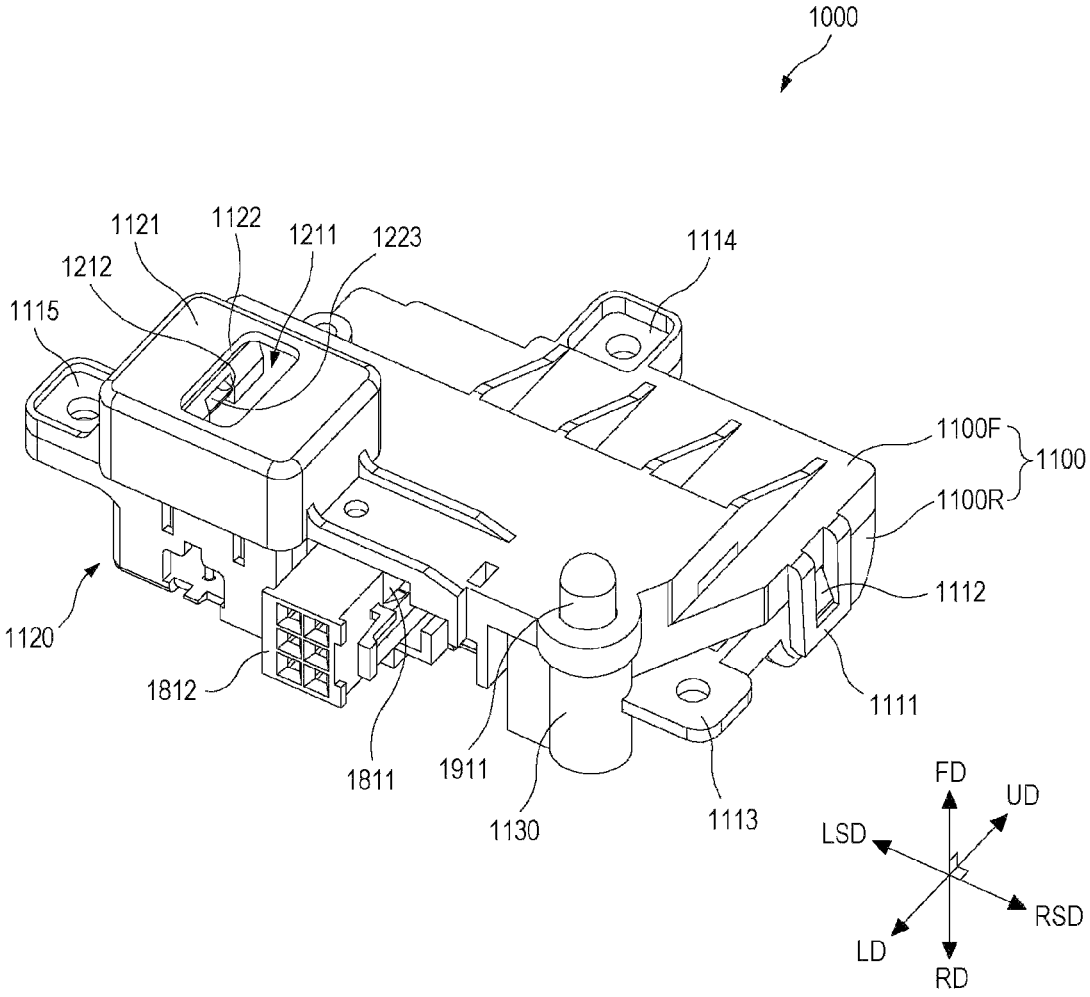
FIG. 3 is a perspective view showing a door lock device according to one embodiment.

Referring to FIG. 3, the housing 1100 comprises a front housing 1100F and a rear housing 1100R which can be coupled with complementary shapes to each other. A plurality of U-shaped engagement portions 1111 protrude rearward on an edge of the front housing 1100F, and wedge-shaped protrusions 1112, which can snap-engage with the engagement portion 1111, are formed in the rear housing 1100R. The front housing 1100F and the rear housing 1100R are coupled together through the snap-engagement of the engagement portion 1111 and the protrusion 1112. The housing 1100 has a plurality of lugs 1113, 1114, 1115 for attachment to, for example, the sub-door frame 141 of the washing machine 100. The door lock device 1000 may be attached to the sub-door frame 141 by means of screw engagement, bolt coupling, etc. through holes formed in the lugs 1113, 1114, 1115.

Figure 6:
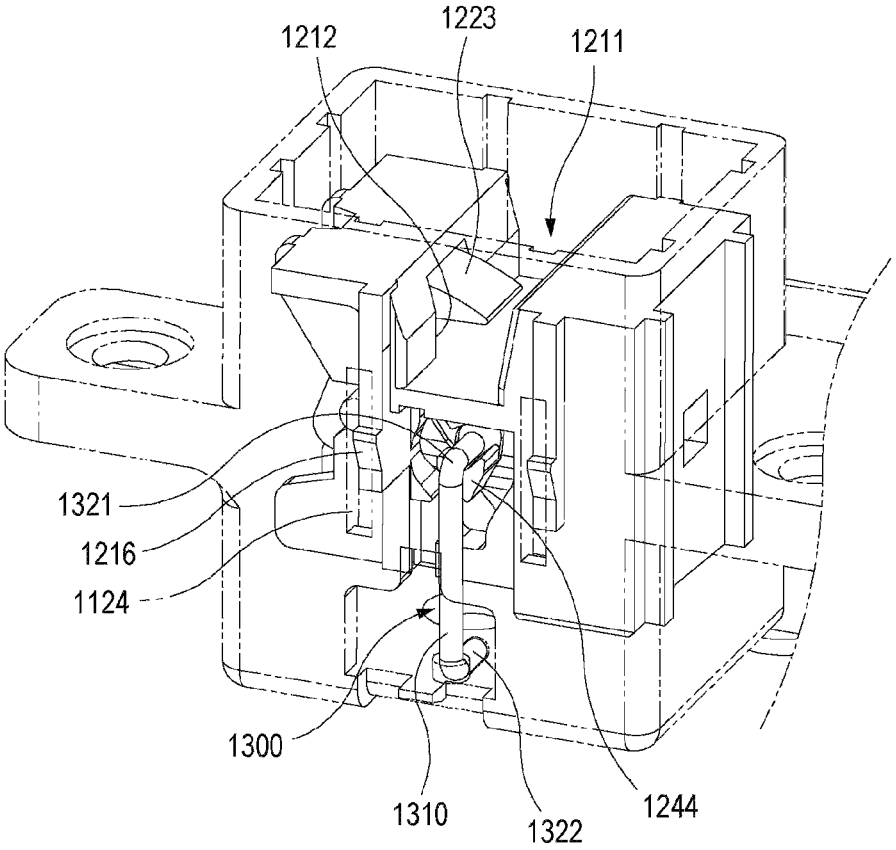
FIG. 6 is a perspective view showing a latch receptacle, a first latch and a second latch.
Figure 7:
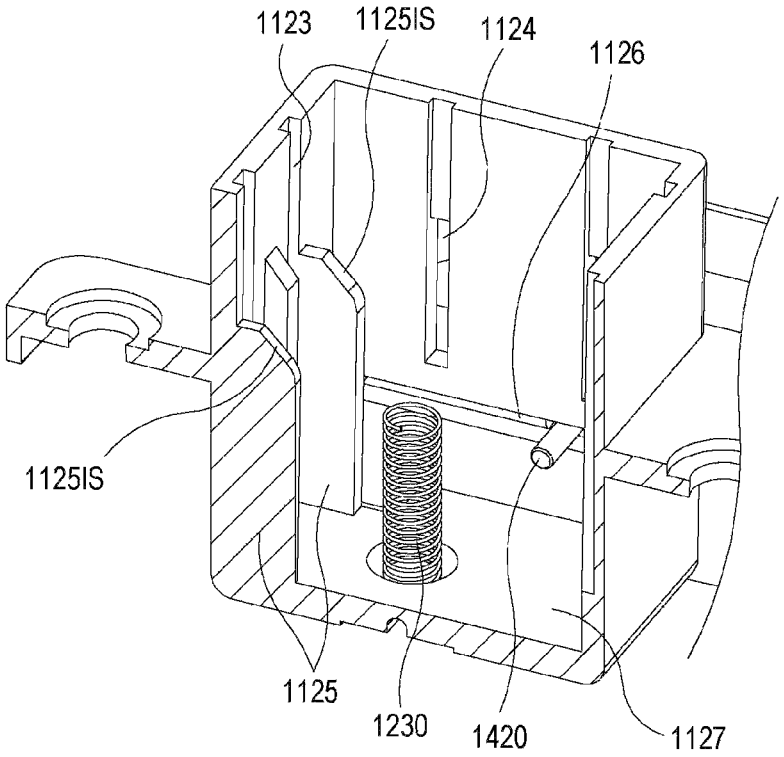
FIG. 7 is a perspective view of the partially-sectioned latch receptacle, showing an interior of the latch receptacle.

The housing 1100 includes a latch receptacle 1120 which receives the first latch 1200 and has a shape of a square barrel. The latch receptacle 1120 extends in the frontward direction PD and the rearward direction RD. The latch receptacle 1120 has a front end portion 1121 in which a key slit 1122 is formed. The door key 143 is inserted to the key slit 1122. The first latch 1200 is coupled to the latch receptacle 1120 to be movable in the frontward direction FD and the rearward direction RD. As shown in FIGS. 6 and 7, side walls of the latch receptacle 1120 are formed with a plurality of guide grooves 1123 and a plurality of guide slits 1124. The latch receptacle 1120 includes, in an inner surface of its side wall, a pair of pressing ribs 1125 for rotating a portion of the first latch 1200 (e.g., a latch hook 1220). Further, the latch receptacle 1120 includes, in its side wall, a guide slit 1126 to which a portion of the third latch 1400 (e.g., a lock pin 1420) is movably inserted. The guide slit 1126 may extend obliquely at a predetermined angle with respect to the movement directions of the first latch 1200 (the frontward direction FD and the rearward direction RD). In this embodiment, the guide slit 1126 extends in a shape of a straight line approximately perpendicularly to the movement directions of the first latch 1200. Alternatively, the guide slit 1126 may extend in a shape of a curved line.

A female connector 1811 of the connectors 1811, 1812 for connection to a controller 150 (see FIG. 32) of the washing machine is coupled to the rear housing 1100R. Electric wires for connection to the controller 150 of the washing machine 100 are coupled to a male connector 1812 which can be mated with the female connector 1811. A circuit board 1820 connected to the female connector 1811 is attached to the rear housing 1100R.

The first latch 1200 includes a movable part which is movable in the frontward direction PD and the rearward direction RD in the latch receptacle 1120, a latch part which is retained in the movable part and engages with the door key 143, and a biasing part for biasing the movable part frontward at all times.

The movable part of the first latch 1200 includes a retainer 1210. The retainer 1210 has a generally hexahedral shape. The retainer 1210 is movably coupled to the latch receptacle 1120 and is movable in the frontward direction FD and the rearward direction RD along the inner surface of the latch receptacle 1120. The latch part of the first latch 1200 includes a latch hook 1220 which is rotatably coupled to the retainer 1210. When the retainer 1210 is moved to the inside of the latch receptacle 1120, i.e., in the rearward direction RD, the latch hook 1220 is brought into engagement with the door key 143. When the retainer 1210 is moved to the outside of the latch receptacle 1120, i.e., in the frontward direction FD, the latch hook 1220 is disengaged from the door key 143. The biasing part of the first latch 1200 comprises the spring 1230. The spring 1230 is disposed between a rear end 1127 of the latch receptacle 1120 and the retainer 1210 (the latch hook 1220) as being slightly compressed. The spring 1230 always biases the retainer 1210 and the first latch 1200 in the frontward direction FD (i.e., toward the door unlocking position DUP). In this embodiment, the spring 1230 comprises a compression coil spring.

The retainer 1210 has, at a front surface thereof, a notch 1211 which extends in an upper direction UD and a lower direction LD and is concave in the rearward direction RD. An opening 1212, from which a portion of the latch hook 1220 protrudes and is retracted, is formed in a lateral surface of the notch 1211 (see FIGS. 3 and 13). The door key 143 of the sub-door 140 is inserted to the notch 1211.

Referring to FIGS. 8 to 12, the retainer 1210 has a pair of support ribs 1213 rotatably supporting the latch hook 1220, a shaft hole 1214 penetrated in each of the support ribs 1213, and a stopper notch 1215 concavely formed in each support rib 1213. Further, the retainer 1210 has a pair of stoppers 1216 in upper and lower surfaces, and has a pair of guide rails 1217 in a lateral surface. The stopper 1216 is fitted to the guide slit 1124 of the latch receptacle 1120, thus preventing the first latch 1200 from being separated to the outside of the latch receptacle 1120. The guide rail 1217 is fitted to the guide groove 1123 of the latch receptacle 1120 and is slidable along the guide groove 1123.

The retainer 1210 includes a spring guide boss 1218 which extends inward below the notch 1211. The spring guide boss 1218 passes through the spring 1230. The spring 1230 is disposed between a rear end of a pressing bar 1225 of the latch hook 1220 and the rear end 1127 of the latch receptacle 1120 as being slightly compressed at the door unlocking position DUP of the first latch 1200.

The latch hook 1220 is rotatably coupled to the support ribs 1213 of the retainer 1210. The latch hook 1220 includes the following: a lever portion 1221; a pair of rotation shaft 1222 formed in a rear end of the lever portion 1221; a hook portion 1223 protruding from a front end of the lever portion 1221 and being engaged with the door key 143 of the sub-door 140; a pair of pressing pins 1224 located approximately midway in the lever portion 1221 and protruding from the lever portion 1221 parallel with the rotation shaft 1222; and a pair of pressing bars 1225 located adjacent to the pressing pins 1224 and protruding from the lever portion 1221 in a rotation direction of the lever portion 1221. The rotation shafts 1222 snap-engage with the shaft holes 1214 of the support ribs 1213 of the retainer 1210, thus rotatably attaching the latch hook 1220 to the retainer 1210. If the latch hook 1220 is rotated to the inside of the retainer 1210, then the pressing pins 1224 are fitted to the stopper notches 1215 of the retainer 1210. The pressing pins 1224 make contact with the pressing ribs 1125 located in the inner surface of the latch receptacle 1120.

As the retainer 1210 is moved to the change position CP, the pressing pins 1224 are brought into contact with inclined surfaces 1125IS of the pressing ribs 1125. Due to the movement of the retainer 1210 in the rearward direction RD and the interaction between the inclined surface 1125IS and the pressing pin 1224, the latch hook 1220 is pushed by the pressing ribs 1125 and is rotated to the inside of the retainer 1210 around the rotation shaft 1222. Then, the pressing pin 1224 is fitted in between the right lateral surface of the pressing rib 1125 and the stopper notch 1215. Thus, the engagement between an engagement groove 144 of the door key 143 and the hook portion 1223 is maintained. When the retainer 1210 is moved to the door unlocking position DUP, the latch hook 1220 is rotated to the outside of the retainer 1210 around the rotation shaft 1222 due to the restoring force of the spring 1230. That is, since the pressing pins 1224 are moved to the inclined surfaces 1125IS of the pressing ribs 1125 during the movement of the retainer 1210 in the frontward direction FD due to the restoring force of the spring 1230, the latch hook 1220 can be rotated.

The first latch 1200 includes grooves which restrict the movement of the first latch 1200 in cooperation with the second latch 1300 and the third latch 1400. In this embodiment, the first latch 1200 includes a latch groove 1240 and a pin groove 1250. The latch groove 1240 functions to lock the first latch 1200 at the door locking position DLP together with the second latch 1300. The pin groove 1250 functions to restrict the first latch 1200 at the door locking position DLP or to push the first latch 1200 toward the change position CP together with the third latch 1400.

Figure 8:
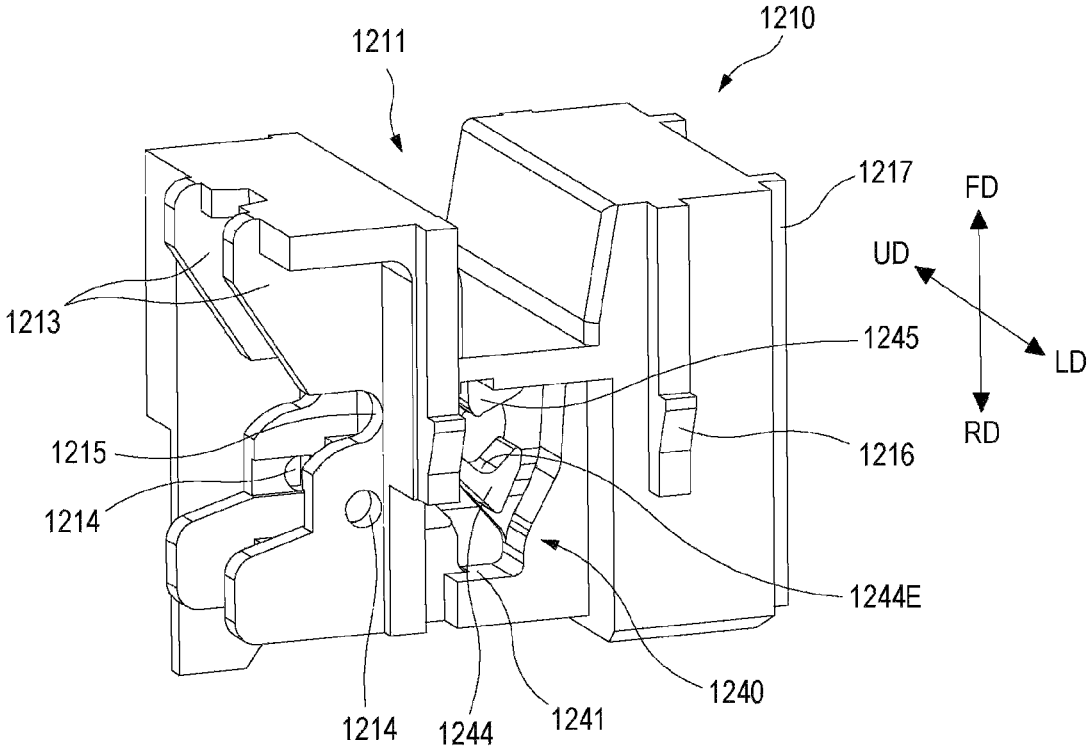
FIG. 8 is a lower perspective view showing a retainer of the first latch.
Figure 9:
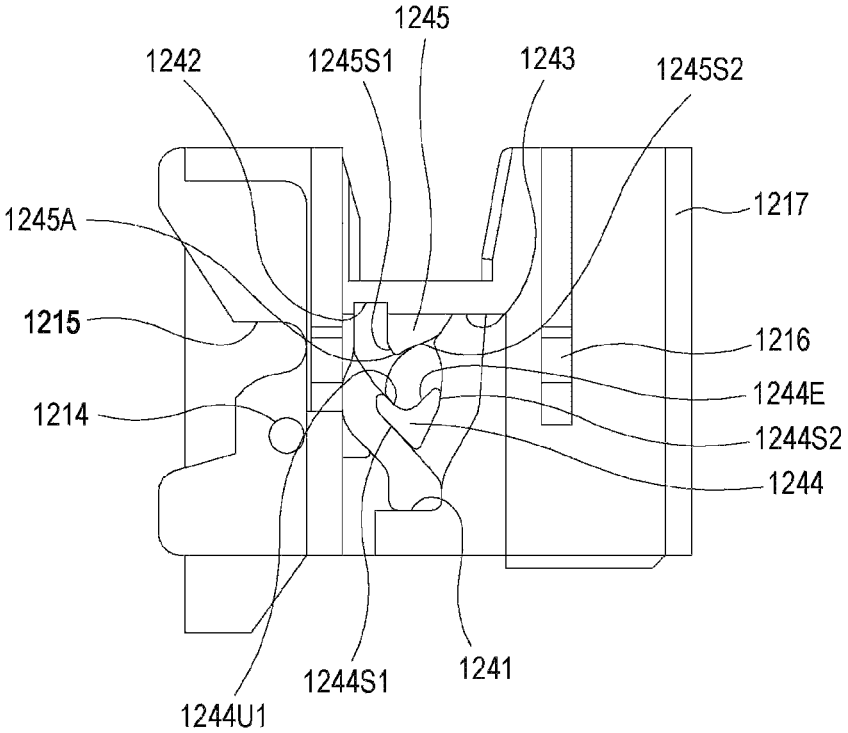
FIG. 9 is a side view of the retainer showing a latch groove.

Referring to FIGS. 8 and 9, the latch groove 1240 is formed in the lower surface of the retainer 1210. The latch groove 1240 generally has a heart shape. A front end portion of the second latch 1300 (e.g., a first bent portion 1321 of the second latch 1300) is moved along the latch groove 1240. The latch groove 1240 has a rear end 1241 located adjacent to the rear end of the retainer 1210, and a first front end 1242 and a second front end 1243 located adjacent to the notch 1211.

A heart-shaped latch stopper 1244 protrudes in the latch groove 1240. A latch guide 1245 protrudes at an upper end of the latch groove 1240 and has a convex surface corresponding to an upper concave surface of the latch stopper 1244. The most convex portion 1245A of the latch guide 1245 is slightly spaced in a left side direction LSD from an engagement portion 1244E which is the most concave portion of the latch stopper 1244.

Figure 10:
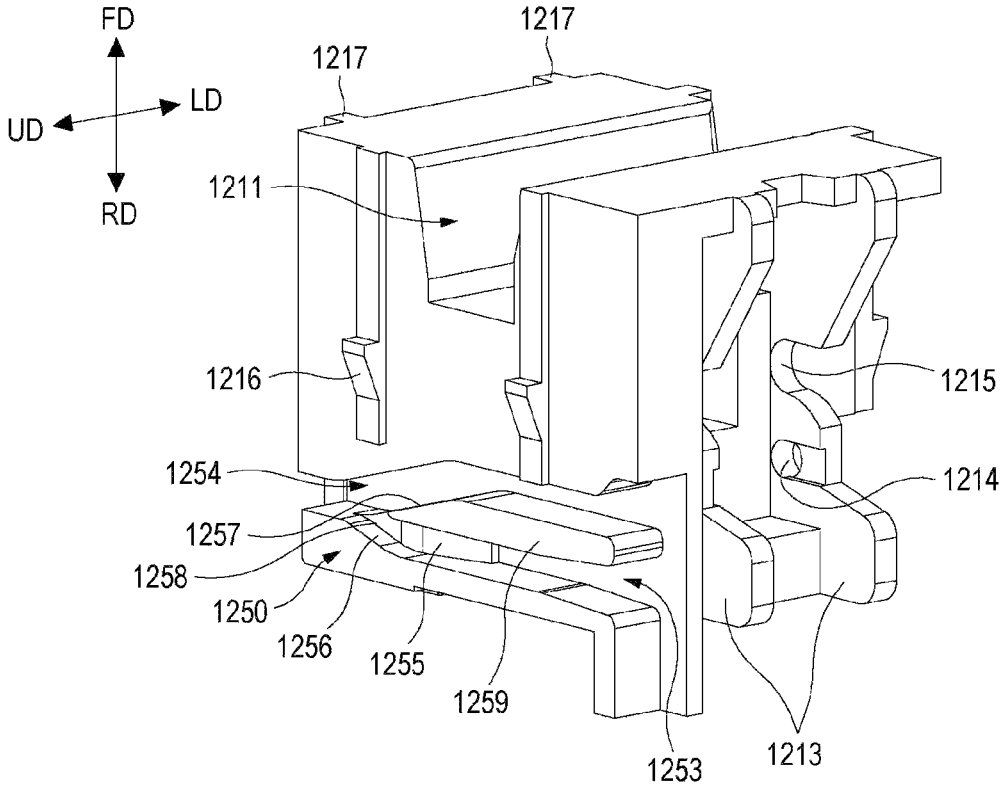
FIG. 10 is an upper perspective view showing the retainer of the first latch.
Figure 11:
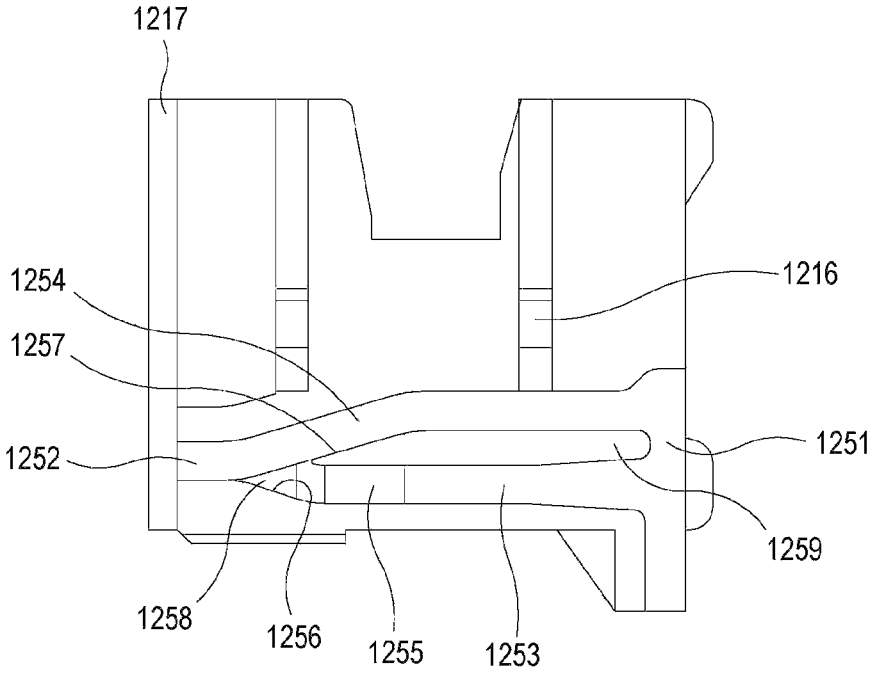
FIG. 11 is a side view of the retainer showing a pin groove.
Figure 12:
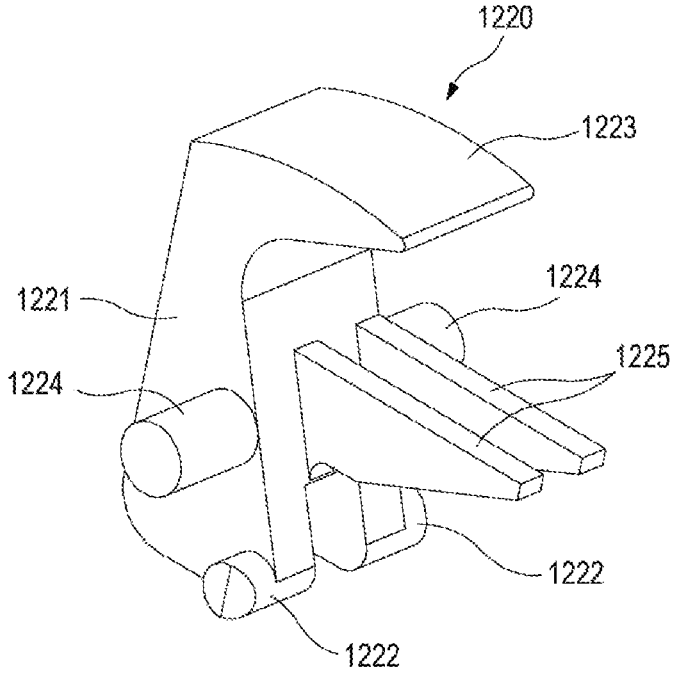
FIG. 12 is a perspective view showing a latch hook.
Figure 13:
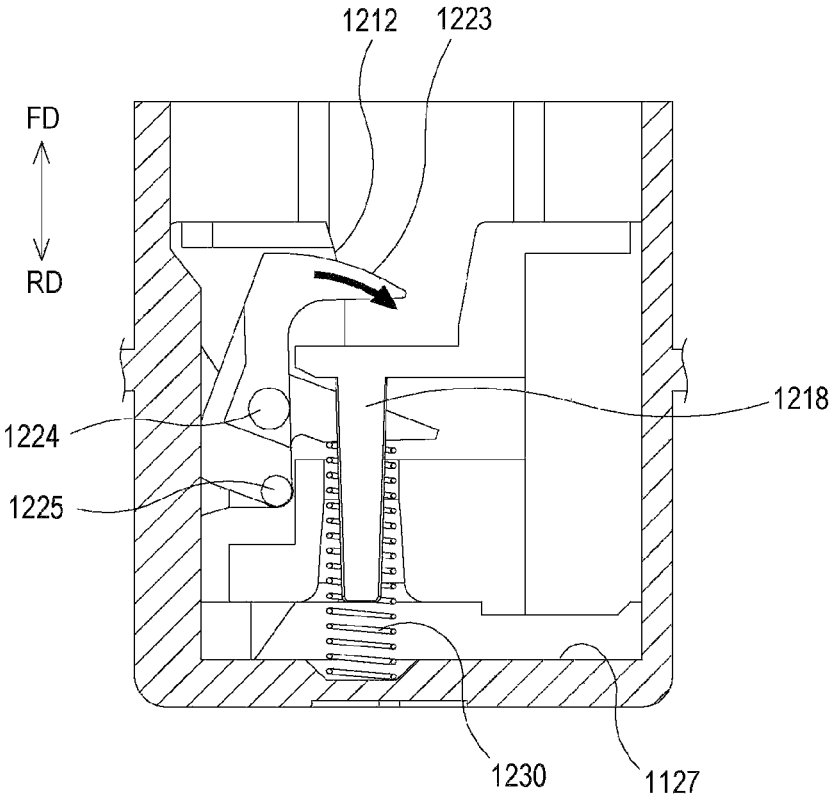
FIG. 13 is a sectional view showing the latch receptacle, the retainer and the latch hook, showing that the first latch is located between a door locking position and a change position.

Referring to FIGS. 10 and 11, the pin groove 1250 is formed in the upper surface of the retainer 1210, which is located opposite to the lower surface of the retainer 1210. The pin groove 1250 is formed adjacent to the rear end of the retainer 1210 in the upper surface of the retainer 1210. The pin groove 1250 extends from a left end of the retainer 1210 to a right end of the retainer 1210. The pin groove 1250 has one end 1251, which is open at the left end of the retainer 1210, and an opposite end 1252, which is open at the right end of the retainer 1210. Further, the pin groove 1250 has an elongated spacer 1259 therein. Thus, the pin groove 1250 has two grooves (i.e., a latch restricting groove 1253 and a latch moving groove 1254) which are divided by the spacer 1259. A portion of the third latch 1400 (e.g., the lock pin 1420) is inserted to the pin groove 1250 through the guide slit 1126 of the latch receptacle 1120. When the retainer 1210 is viewed from the top, the pin groove 1250 may have a V-like shape or a U-like shape. Thus, one side of such V-shape or U-shape becomes the latch restricting groove 1253, while the other side of such V-shape or U-shape becomes the latch moving groove 1254.

The latch restricting groove 1253 extends generally linearly or slight curvedly along a rear surface of the spacer 1259. The latch restricting groove 1253 may be inclined with respect to the movement directions (the frontward direction PD and the rearward direction RD) of the first latch 1200. In this embodiment, the latch restricting groove 1253 extends generally perpendicularly to the movement directions of the first latch 1200. When a portion of the third latch 1400 (e.g., the lock pin 1420) is positioned in the latch restricting groove 1253, the first latch 1200 is locked and restricted by the third latch 1400 at the door locking position DLP. The latch moving groove 1254 extends from the latch restricting groove 1253 along a front surface of the spacer 1259 and is spaced apart from the latch restricting groove 1253 by the spacer 1259. The latch restricting groove 1253 and the latch moving groove 1254 are interconnected at the opposite end 1252. A spacing distance between the latch restricting groove 1253 and the latch moving groove 1254 in the frontward direction FD and the rearward direction RD may correspond to a distance between the door locking position DLP and the change position CP. A portion of the latch moving groove 1254 is inclined with respect to the latch restricting groove 1253. As a portion of the third latch 1400 (e.g., the lock pin 1420) slides along a portion of the latch moving groove 1254, the first latch 1200 is pushed toward the change position CP due to a reaction from such a slide movement.

The pin groove 1250 has, in the latch restricting groove 1253, a first inclined surface 1255 inclined in the lower direction LD and a second inclined surface 1256 inclined in the frontward direction FD. Further, the pin groove 1250 has a guide surface 1257, which is inclined in the rearward direction RD, between the latch restricting groove 1253 and the latch moving groove 1254. The guide surface 1257 is located adjacent to the opposite end of the spacer 1259 and forms a portion of an upper surface of the spacer 1259 at the opposite end of the spacer 1259. The guide surface 1257 guides a portion of the third latch 1400 (e.g., the lock pin 1420) from the latch restricting groove 1253 to the latch moving groove 1254. The first inclined surface 1255 and the second inclined surface 1256 are generally perpendicular to each other. At the opposite end of the spacer 1259, a pin passage 1258 through which the aforementioned portion of the third latch 1400 passes is formed between the second inclined surface 1256 and the guide surface 1257.

The second latch 1300 is disposed in the latch receptacle 1120 of the housing 1100 and locks the first latch 1200 (specifically, the retainer 1210) at the door locking position DLP. As shown in FIG. 6, the second latch 1300 has a shape of a bar. The second latch 1300 has a linear portion 1310. Further, the second latch 1300 has a first bent portion 1321 and a second bent portion 1322 which are bent from the linear portion 1310 at front and rear ends of the linear portion 1310 respectively. The first bent portion 1321 of the second latch 1300 is positioned in the latch groove 1240. The second latch 1300 is rotatably attached to a rear end 1127 of the latch receptacle 1120 at the second bent portion 1322.

When the user presses the sub-door 140 one time, the door lock device 1000 locks the sub-door 140 by the first latch 1200. When the user presses the sub-door 140 one time again, the door lock device 1000 release the lock between the sub-door 140 and the first latch 1200. The latch groove 1240 of the first latch 1200 and the second latch 1300 accomplishes the locking of the sub-door 140 caused by the aforementioned one-time pressing and the unlocking of the sub-door 140 caused by the aforementioned another one-time pressing.

Figure 14:
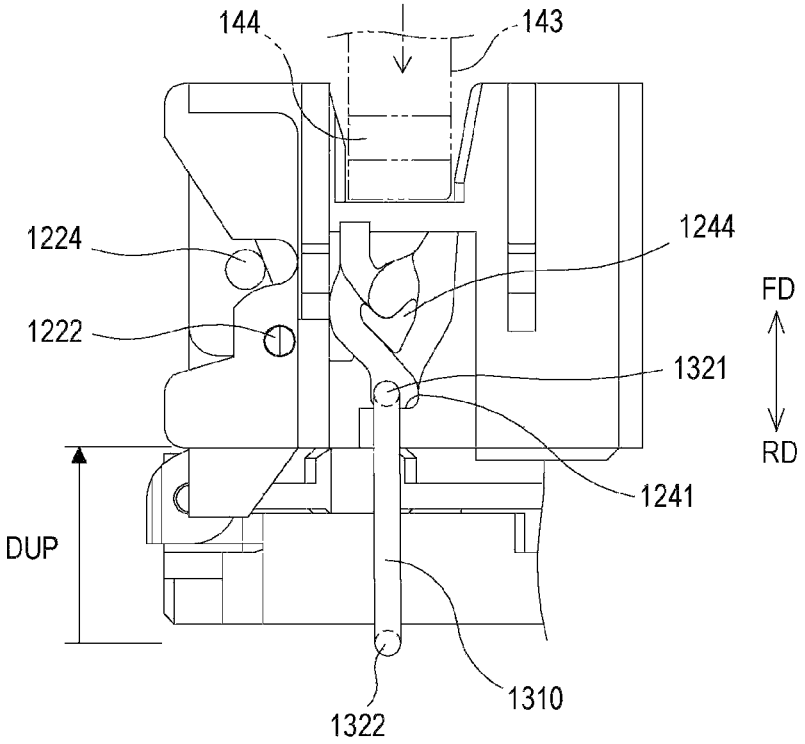
FIG. 14 shows an example of locking between the first latch and the second latch wherein the first latch is located at a door unlocking position.
Figure 15:
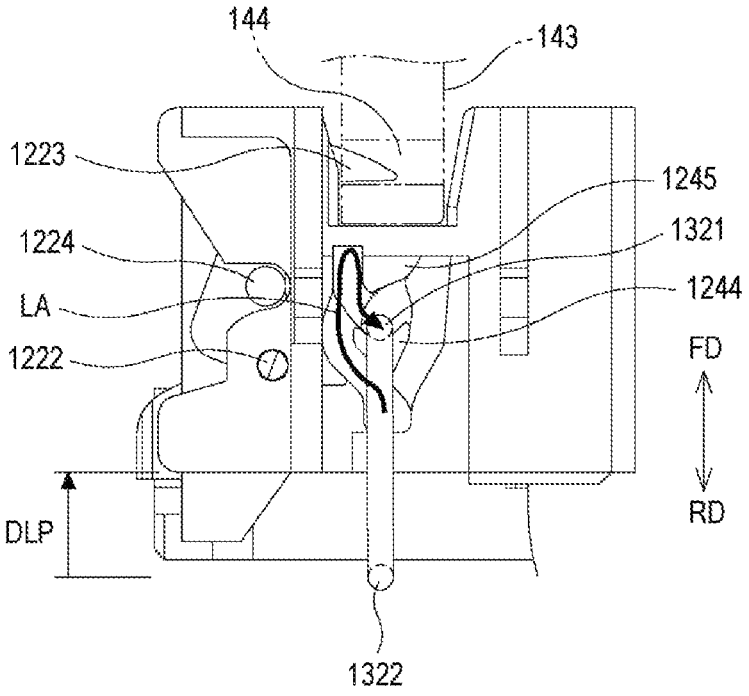
FIG. 15 shows an example of locking between the first latch and the second latch, wherein the first latch is locked at the door locking position by the second latch.
Figure 16:
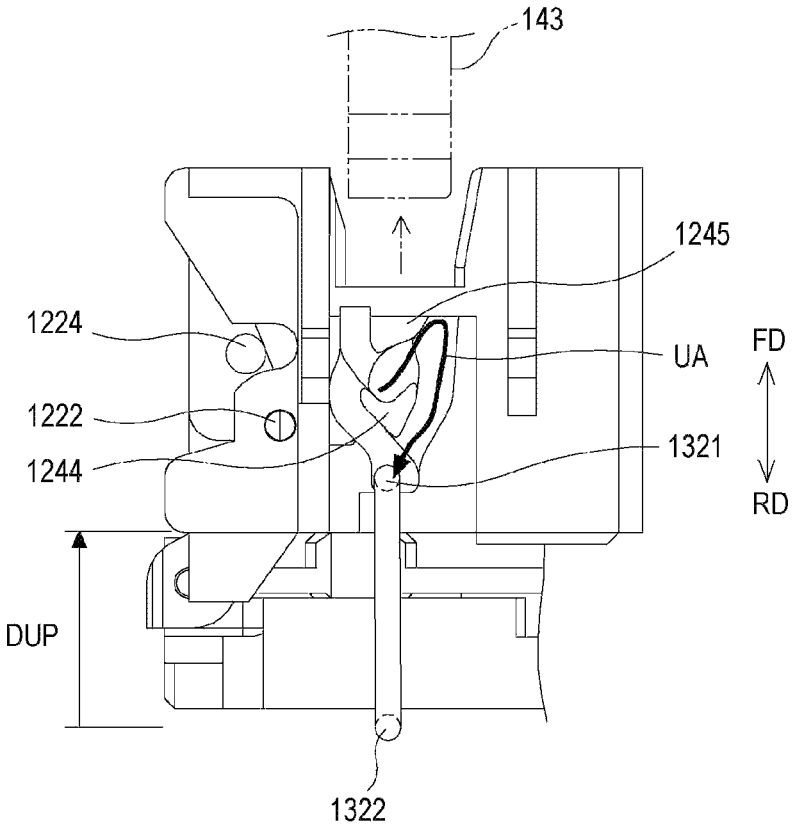
FIG. 16 shows an example of locking between the first latch and the second latch, wherein the first latch returns to the door unlocking position.
Figure 17:
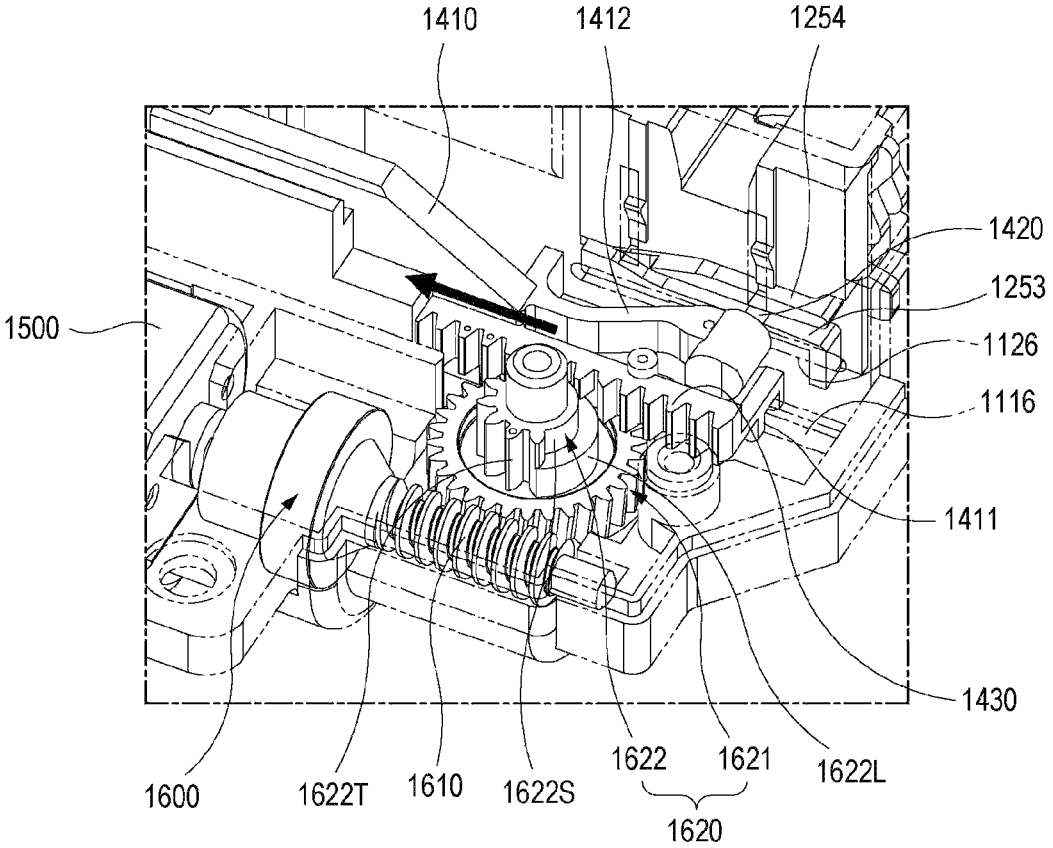
FIG. 17 is a perspective view showing a third latch, a drive motor and a latch drive mechanism.

The locking and unlocking of the sub-door 140 are described with reference to FIGS. 9 and 14 to 16. FIGS. 14 to 16 show an example of the lock between the first latch 1200 and the second latch 1300 and the interaction between the latch groove 1240 and the second latch 1300. As shown in FIG. 14, the first latch 1200 is located at the door unlocking position DUP. Further, the first bent portion 1321 of the second latch 1300 is positioned at a rear end 1241 of the latch groove 1240. The first latch 1200 is biased in the frontward direction FD due to the force of the spring 1230, but the first latch 1200 is maintained at the door unlocking position DUP by the second latch 1300 due to the engagement between the rear end 1241 of the latch groove 1240 and the first bent portion 1321 of the second latch 1300. Alternatively, the stopper 1216 of the retainer 1210 is brought into contact with a front end of the guide slit 1124 of the latch receptacle 1120, maintaining the first latch 1200 at the door unlocking position DUP. The latch hook 1220 is rotated due to the force of the spring 1230 such that the hook portion 1223 is retracted from the notch 1211.

If the user closes the sub-door 140, the door key 143 is inserted to the notch 1211. If the user presses the sub-door 140 toward the washing machine 100 in order to lock the sub-door 140, the first latch 1200 is pushed to the inside of the latch receptacle 1120, i.e. in the rearward direction RD, and is thus moved to the change position CP. Together with the movement of the first latch 1200 to the change position CP, the first bent portion 1321 of the second latch 1300 is moved along a left lateral surface 1244S1 of the latch stopper 1244 up to the first front end 1242 of the latch groove 1240 and is thus brought into contact with the first front end 1242. The position of the first latch 1200 at the time when the first bent portion 1321 is brought into contact with the first front end 1242 becomes the change position CP. While the first latch 1200 is moved from the door unlocking position DUP to the change position CP, the latch hook 1220 is rotated toward the notch 1211 around the rotation shaft 1222 due to the interaction between the pressing pins 1224 of the latch hook 1220 and the pressing ribs 1125 of the latch receptacle 1120. Together with such rotation, the hook portion 1223 of the latch hook 1220 enters into the notch 1211 through the opening 1212 and is brought into engagement with the engagement groove 144 of the door key 143.

If the first latch 1200 reaches the change position CP, the first bent portion 1321 of the second latch 1300 is brought into contact with the first front end 1242 of the latch groove 1240. Thus, the user cannot press the sub-door 140 any more and release the force applied to the sub-door 140. Then, the first latch 1200 is moved toward the door unlocking position DUP, i.e. in the frontward direction FD due to the force of the spring 1230. At the same time, the first bent portion 1321 of the second latch 1300 enters into the engagement portion 1244E of the latch stopper 1244 along a left lateral surface 1245S1 of the latch guide 1245 and a first upper surface 1244U1 of the latch stopper 1244. Thus, the engagement between the first bent portion 1321 of the second latch 1300 and the engagement portion 1244E of the latch guide 1245 restricts the movement of the first latch 1200 toward the door unlocking position DUP (i.e., the forward movement), thus locking the first latch 1200. The position of the first latch 1200 at the time when the movement of the first latch 1200 toward the door unlocking position DUP is restricted becomes the door locking position DLP (see FIG. 15). An arrow LA shown in FIG. 15 indicates the movement path of the first bent portion 1321 of the second latch 1300 while the first latch 1200 is moved from the door unlocking position DUP to the change position CP, and thereafter from the change position CP to the door locking position DLP. At the door locking position DLP of the first latch 1200, the first latch 1200 is locked by the second latch 1300 and the hook portion 1223 is in engagement with the engagement groove 144 of the door key 143. Thus, the sub-door 140 is locked by the first latch 1200.

If the user presses the sub-door 140 a second time, then the sub-door 140 is unlocked from the first latch 1200. FIG. 16 shows that the engagement between the door key 143 and the first latch 1200 is released through the user's second one-time pressing when the first latch 1200 is positioned at the door locking position DLP. An arrow UA shown in FIG. 16 indicates the movement path of the first bent portion 1321 of the second latch 1300 when the user presses the sub-door 140 a second time. If the user presses the sub-door 140 a second time, the first latch 1200 is pushed from the door locking position DLP in the rearward direction RD and is thus positioned at the change position CP. Then, the first bent portion 1321 of the second latch 1300 is separated from the latch stopper 1244 and is brought into contact with the second front end 1243 of the latch groove 1240 along a right lateral surface 1245S2 of the latch guide 1245. Then, the user cannot press the sub-door 140 any more and thus release the force applied to the sub-door 140. Then, the first latch 1200 is moved from the change position CP toward the door unlocking position DUP due to the force of the spring 1230. At the same time, the first bent portion 1321 of the second latch 1300 is moved along a right lateral surface 1244S2 of the latch stopper 1244 to the rear end 1241 of the latch groove 1240. Further, at the same time, the latch hook 1220 is rotated due to the force of the spring 1230 such that the hook portion 1223 is retracted from the notch 1211.

The door lock device 1000 includes the third latch 1400 releasably locking the first latch 1200 which is located at the door locking position DLP as being in engagement with the door key 143. The third latch 1400 is movably disposed in the housing 1100. The third latch 1400 restricts the first latch 1200 at the door locking position DLP. The third latch 1400 pushes the first latch 1200 from the door locking position DLP to the change position CP in cooperation with the pin groove 1250 of the first latch 1200. Further, if the first latch 1200 reaches the change position CP, the third latch 1400 unlocks the first latch 1200.

The third latch 1400 may be coupled to the housing 1100 so as to move in a direction inclined at a predetermined angle with respect to the movement directions of the first latch 1200 (the frontward direction FD and the rearward direction RD). In this embodiment, the third latch 1400 is coupled to the housing 1100 so as to be slidable in the left side direction LSD and the right side direction RSD. Specifically, referring to FIGS. 5 and 17, the third latch 1400 includes the following: a slider 1410 extending in the left side direction LSD and the right side direction RSD; the lock pin 1420 disposed at one end or left side end of the slider 1410 and inserted to the pin groove 1250 of the first latch 1200; and a rack gear 1430 located opposite the lock pin 1420 and coupled to or integrally formed with the slider 1410.

The slider 1410 has a slide groove 1411 in its rear surface. A slide rail 1116 corresponding to the slide groove 1411 is formed in a front surface of the rear housing 1100R. The slide rail 1116 extends in the housing 1100 in the left side direction LSD and the right side direction RSD. The slider 1410 is attached to the rear housing 1100R through the slidable engagement between the slide groove 1411 and the slide rail 1116. Thus, the slider 1410 is movable in the housing 1100 in the left side direction LSD and the right side direction RSD which are perpendicular to the frontward direction FD and the rearward direction RD.

Figure 21:
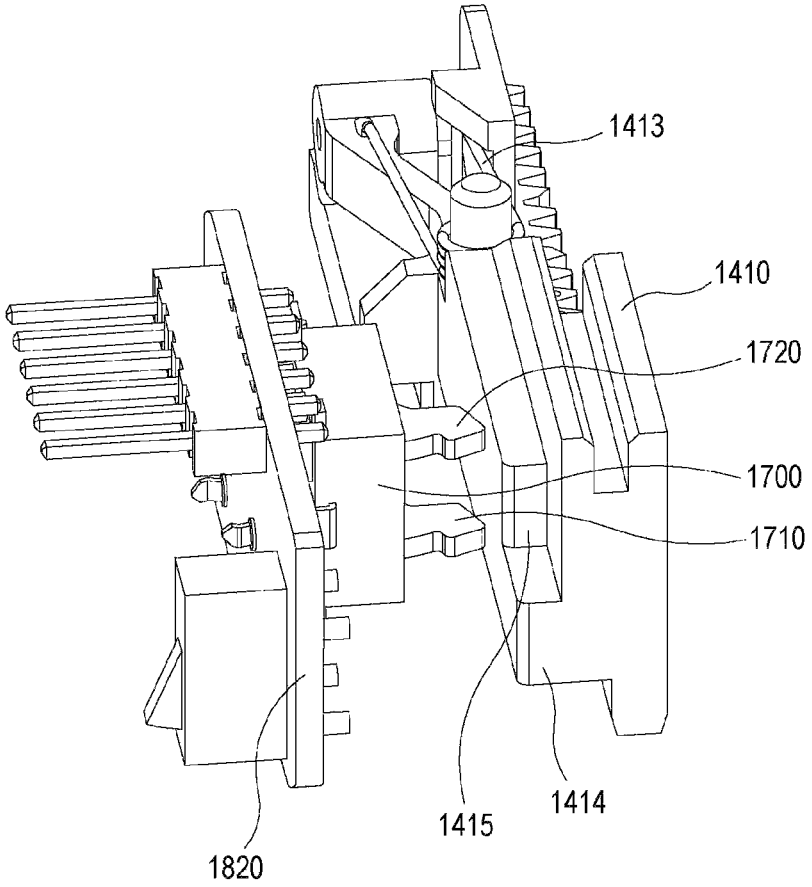
FIG. 21 is a perspective view showing a slider and a detector of the third latch.

The slider 1410 includes an elastic arm 1412 which extends from the middle of the slider toward one end of the slider. The lock pin 1420 protrudes frontward from a tip end of the arm 1412. The arm 1412 has a cantilever shape. The arm 1412 extends from the slider 1410 such that the lock pin 1420 is positioned in the pin groove 1250. Since the arm 1412 is capable of elastically curving in the rearward direction RD, the arm 1412 biases the lock pin 1420 toward the pin groove 1250. Thus, the lock pin 1420 can be displaced in the rearward direction RD and return in the frontward direction FD. The slider 1410 may include a spring which biases the arm 1412 and the lock pin 1420 in the frontward direction FD. For example, as shown in FIG. 21, a torsion spring 1413 may be disposed in the slider 1410 to bias the arm 1412 in the frontward direction FD.

The third latch 1400 is moved by the electric drive source and the latch drive mechanism which moves the third latch 1400 by the drive force generated from the drive source. A portion of the aforementioned latch drive mechanism is coupled to the rack gear 1430. Specifically, by virtue of the aforementioned electric drive source and latch drive mechanism, the third latch 1400 is moved to the following positions: a latch unlocking position LUP where the third latch 1400 unlocks the first latch 1200 and therefore the first latch 1200 is not restricted at the door locking position DLP and the change position CP (see FIGS. 23 and 29); a latch restricting position LRP where the third latch 1400 restricts the first latch 1200 at the door locking position DLP (see FIG. 23); and a latch moving position LMP where the third latch 1400 pushes the first latch 1200 from the door locking position LDP to the change position CP and positions the first latch 1200 at the change position CP (see FIG. 29). Thus, the lock pin 1420 of the third latch 1400 is also moved to the latch unlocking position LUP, the latch restricting position LRP and the latch moving position LMP.

The latch unlocking position LUP, the latch restricting position LRP and the latch moving position LMP may be located in line. In such a case, an imaginary straight line, which the latch unlocking position LUP, the latch restricting position LRP and the latch moving position LMP make, is inclined with respect to the movement directions of the first latch 1200 (the frontward direction FD and the rearward direction RD). In this embodiment, an imaginary straight line, which the latch unlocking position LUP, the latch restricting position LRP and the latch moving position LMP make, is perpendicular to the movement directions of the first latch 1200. Thus, the lock pin 1420 of the third latch 1400 is linearly moved. Further, the latch unlocking position LUP, the latch restricting position LRP and the latch moving position LMP may be located on a single imaginary line in such an order. Alternatively, on a single imaginary line, the latch moving position LMP may be located between the latch unlocking position LUP and the latch restricting position LRP. Further, by virtue of the aforementioned electric drive source and latch drive mechanism, the movement of the third latch 1400 may be changed between the latch restricting position LRP and the latch moving position LMP.

In this embodiment, at the latch restricting position LRP, the lock pin 1420 of the third latch 1400 is located in the latch restricting groove 1253 of the pin groove 1250 of the first latch 1200. Regarding the movement from the latch restricting position LRP to the latch moving position LMP, the lock pin 1420 applies a force to the first latch 1200 through the contact between the lock pin 1420 and the pin groove 1250 together with the movement of the third latch 1400. As a result, the first latch 1200 is pushed to the change position CP. That is, the lock pin 1420 sliding along the pin groove 1250 applies the force, which is caused by the movement of the third latch 1400, to the pin groove 1250, and therefore the first latch 1200 is pushed to the change position CP. When the lock pin 1420 passes the second inclined surface 1256, the first latch 1200 is slightly moved from the door locking position DLP toward the change position CP due to the second inclined surface 1256 of the pin groove 1250. Further, if the lock pin 1420 reaches the end of the guide surface 1257 beyond the guide surface 1257, the first latch 1200 is positioned at the change position CP. Thus, in this embodiment, the latch moving position LMP comprises a first latch moving position LMP1 where the first latch 1200 is moved from the door locking position DLP toward the change position CP, and a second latch moving position LMP2 where the first latch 1200 is positioned from the door locking position DLP to the change position CP. The second latch moving position LMP2 is located between the first latch moving position LMP1 and the latch unlocking position LUP.

The door lock device 1000 includes a drive motor 1500 which function as the aforementioned electric drive source, and a latch drive mechanism 1600 which is operably coupled to the drive motor 1500 and drives (actuates or moves) the third latch 1400 by the drive force generated from the drive motor 1500.

In this embodiment, the drive motor 1500 comprises a DC motor which is capable of rotating its rotation shaft in a normal direction and a reverse direction. By way of example, if the drive motor 1500 generates a normal-directional rotation, the lock pin 1420 of the third latch 1400 may be moved from the latch unlocking position LUP to the latch restricting position LRP by the latch drive mechanism 1600. Further, if the drive motor 1500 generates the normal-directional rotation when the lock pin 1420 is in the latch restricting position LRP, the lock pin 1420 may be moved from the latch restricting position LRP to the first latch moving position LMP1. Further, if the drive motor 1500 generates a reverse-directional rotation when the lock pin 1420 is in the first latch moving position LMP1, the lock pin 1420 may return from the first latch moving position LMP1 to the latch unlocking position LUP or to the latch unlocking position LUP via the second latch moving position LMP2.

In this embodiment, the latch unlocking position LUP is a position where the first latch 1200 locked by the second latch 1300 is located at the door locking position DLP and the lock pin 1420 is slightly spaced apart from the one end 1251 of the pin groove 1250. The latch restricting position LRP is a position where the first latch 1200 is located at the door locking position DLP and the lock pin 1420 is located approximately midway in the latch restricting groove 1253 of the pin groove 1250. The first latch moving position LMP1 is a position where the first latch 1200 is slightly moved from the door locking position DLP toward the change position CP and the second latch 1300 unlocks the first latch 1200. The second latch moving position LMP2 is a position where the first latch 1200 is located at the change position CP and the lock pin 1420 of the third latch 1400 is located approximately midway in the latch moving groove 1254 (e.g., at the end of the guide surface 1257).

The latch drive mechanism 1600 converts the rotational motion generated by the drive motor 1500 into a linear motion, and moves the third latch 1400 to the latch unlocking position LUP, the latch restricting position LRP and the latch moving position LMP. The latch drive mechanism 1600 includes a worm 1610, which is coaxially coupled to the rotation shaft of the drive motor 1500, and a worm gear 1620 which is meshed with the worm 1610 and the rack gear 1430. The worm 1610 is normally and reversely rotated due to the normal and reverse rotation generated by the drive motor 1500. Along with the rotation of the worm 1610, the third latch 1400 is moved in the left side direction LSD and the right side direction RSD through the worm gear 1620 and the rack gear 1430. In this embodiment, the worm gear 1620 takes the form of a double gear. The worm gear 1620 includes a helical spur gear 1621 which is in mesh with the worm 1610, and a pinion gear 1622 which is coaxially coupled to the helical spur gear 1621 and has a size smaller than the helical spur gear 1621. The number of gear teeth of the pinion gear 1622 is fewer than that of the helical spur gear 1621. The pinion gear 1622 is in mesh with the rack gear 1430.

Figure 18:
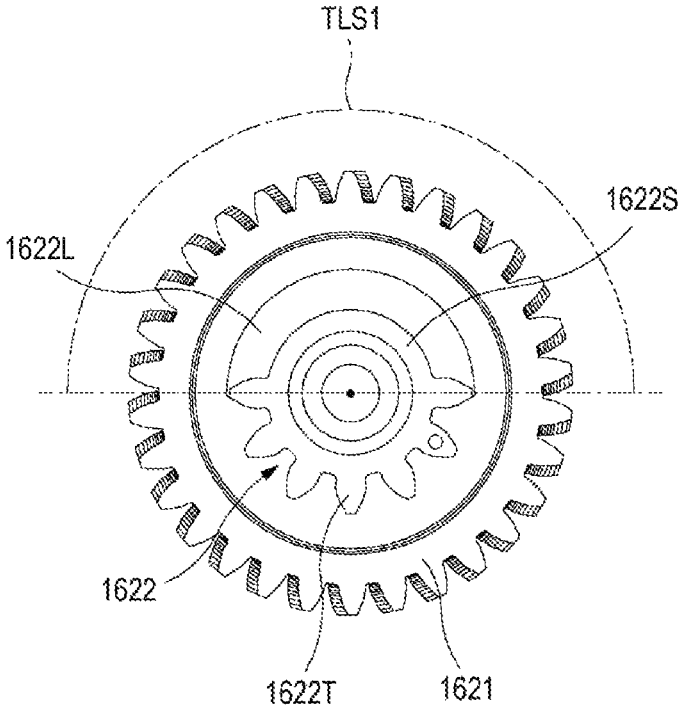
FIG. 18 is a front view showing a pinion gear of a worm gear.
Figure 19:
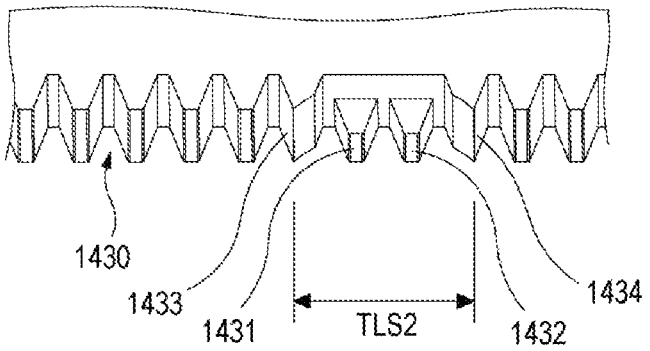
FIG. 19 is a perspective view showing a portion of a rack gear of the third latch.

In this embodiment, the pinion gear 1622 is a toothless gear which does not have gear teeth in some portion of its perimeter. That is, the pinion gear 1622 has a toothless section TLS1 at some portion of its perimeter. Specifically, as shown in FIG. 18, the pinion gear 1622 does not have gear teeth throughout a portion of about 180 degrees of its perimeter. Further, as shown in FIG. 19, the rack gear 1430 includes a toothless section TLS2 which corresponds to the toothless section TLS1 of the pinion gear 1622. The toothless section TLS2 of the rack gear 1430 is positioned in the rack gear 1430 such that the toothless section TLS2 enters into the toothless section TLS1 of the pinion gear 1622 at the latch restricting position LRP of the third latch 1400 during the gear transmission between the pinion gear 1622 and the rack gear 1430. Gear teeth 1431, 1432, which have a thickness thinner than gear teeth 1433, 1434 located at both ends of the toothless section TLS2, are disposed in the toothless section TLS2 of the rack gear 1430. Alternatively, the rack gear 1430 may have no gear teeth in the toothless section TLS2.

If the toothless section TLS2 of the rack gear 1430 enters into the toothless section TLS1 of the pinion gear 1622, the gear transmission between the pinion gear 1622 and the rack gear 1430 is paused. The pinion gear 1622 includes a stopper which fixes the rack gear 1430 and the slider 1410 at the latch restricting position LRP. Specifically, the pinion gear 1622 includes a plurality of gear teeth 1622T, a stopper 1622S and a toothless portion 1622L. The stopper 1622S and the toothless portion 1622L are located opposite the gear teeth 1622T. The stopper 1622S and the toothless portion 1622L correspond to the toothless section TLS1 of the pinion gear 1622. The stopper 1622S has a shape of a semi-cylindrical shape which has a radius corresponding to a distance from a rotation center of the pinion gear 1622 to a tooth end of the gear tooth 1622T. The toothless portion 1622L is disposed coaxially with the stopper 1622S and has a semi-cylindrical shape having a radius smaller than the stopper 1622S. The pinion gear 1622 is positioned with respect to the rack gear 1430 such that the gear teeth 1622T make contact with the gear teeth of the rack gear 1430 and the toothless portion 1622L does not make contact with the gear teeth of the rack gear 1430.

Further, as shown in FIG. 19, the gear teeth 1431 and 1432, which are located midway in the toothless section TLS2 of the rack gear 1430, are formed so as not to make contact with the stopper 1622S. The gear teeth 1431 and 1432, which are adjacent in the toothless section TLS2, have a thickness thinner than the thickness of other gear teeth. That is, the gear teeth 1431 and 1432 have a thickness at which the gear teeth 1431 and 1432 do not make contact with the stopper 1622S. Further, the gear tooth 1433 and the gear tooth 1434, which are located at both ends of the toothless section TLS2, have a tooth surface which is bent to prevent interference with the stopper 1622S. The gear tooth 1433 and the gear tooth 1434 can make contact with the stopper 1622S.

Figure 20:
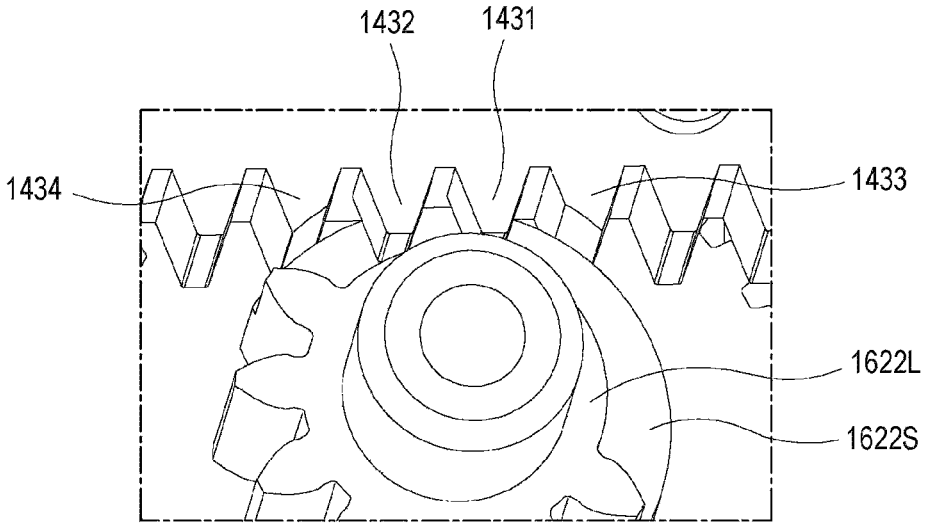
FIG. 20 shows an example of meshing between the pinion gear and the rack gear wherein a toothless section of the rack gear enters into a toothless section of the pinion gear.

A DC motor may be used as the drive motor 1500. In such a case, although the electric power applied to the drive motor 1500 is cut off, the drive motor 1500 generates rotation to some extent because of the inertia of a rotor provided in the drive motor. Further, the third latch 1400 fails to precisely stop at the latch restricting position LRP, instead may stop in the vicinity of the latch restricting position LRP with little error. However, the door lock device 1000 is capable of precisely stopping the third latch 1400 at the latch restricting position LRP. That is, as shown in FIG. 20, if the toothless section TLS2 of the rack gear 1430 enters into the toothless section TLS1 of the pinion gear 1622 at the latch restricting position LRP and the electric power supply to the drive motor 1500 is cut off, then the toothless portion 1622L of the pinion gear 1622 does not mesh with the gear teeth 1431 to 1434 of the rack gear 1430 any more and therefore the aforementioned gear transmission is paused. Further, when the toothless section TLS1 of the pinion gear 1622 is in the toothless section TLS2 of the rack gear 1430 at the latch restricting position LRP, the stopper 1622S of the pinion gear 1622 is located between the gear teeth 1433 and 1434 which are located at both ends of the toothless section TLS2. Thus, the rack gear 1430 is caught by the pinion gear 1622 because of the contact between the stopper 1622S and the gear teeth 1433 and 1434, and cannot be moved left and right. That is, the stopper 1622S of the pinion gear 1622 is located at the toothless section TLS2 of the rack gear 1430, thus fixing the slider 1410 to the latch restricting position LRP. Thus, the third latch 1400 and the lock pin 1420 can be stably maintained at the latch restricting position LRP. Further, when the toothless section TLS1 of the pinion gear 1622 is in the toothless section TLS2 of the rack gear 1430, a gap exists between the gear tooth 1622T of the pinion gear 1622 and the gear tooth 1433, 1434 of the rack gear 1430. Due to such a gap, the pinion gear 1622 has a space for free rotation of, for example, about 120 degrees.

Figure 5:
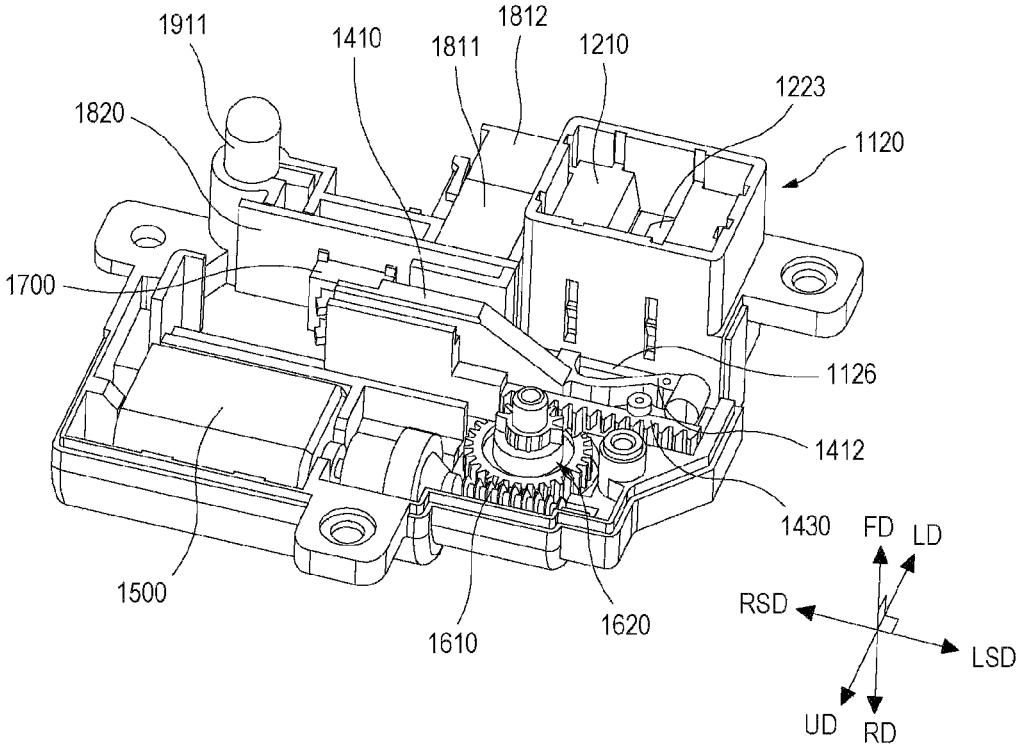
FIG. 5 is a perspective view of the door lock device with a front housing removed, which is viewed in another direction.

The door lock device 1000 includes a detector 1700 for detecting the movement of the third latch 1400 to the latch restricting position LRP. Referring to FIGS. 5 and 21, in this embodiment, the detector 1700 comprises a first detection switch 1710 and a second detection switch 1720 which respectively generate ON signals through the contact between a lever and the third latch 1400. The detector 1700 is disposed in the housing 1100 in the vicinity of the opposite end of the slider 1410. The slider 1410 of the third latch 1400 includes first and second switch activating portions 1414 and 1415 which are brought into contact with the first and second detection switches 1710 and 1720 respectively and activate the first and second detection switches 1710 and 1720 respectively. The first and second switch activating portions 1414 and 1415 are formed as a shape of a step at the opposite end of the slider 1410. The second switch activating portion 1415 is spaced apart from the first switch activating portion 1414 in a direction directed to the latch unlocking position LUP of the third latch 1400. The first detection switch 1710 is positioned so as to make contact with the first switch activating portion 1414 of the slider 1410 when the third latch 1400 is moved by a predetermined distance (e.g., about 1.5 mm) from the latch unlocking position LUP to the latch restricting position LRP. The second detection switch 1720 is positioned so as to make contact with the second switch activating portion 1415 of the slider 1410 when the third latch 1400 approaches or reaches the latch restricting position LRP, for example, when the third latch 1400 is moved about 6.7 mm from the latch unlocking position LUP to the latch restricting position LRP. The ON signals generated from the first detection switch 1710 and the second detection switch 1720 are transmitted to the controller 150 of the washing machine 100.

Figure 22:
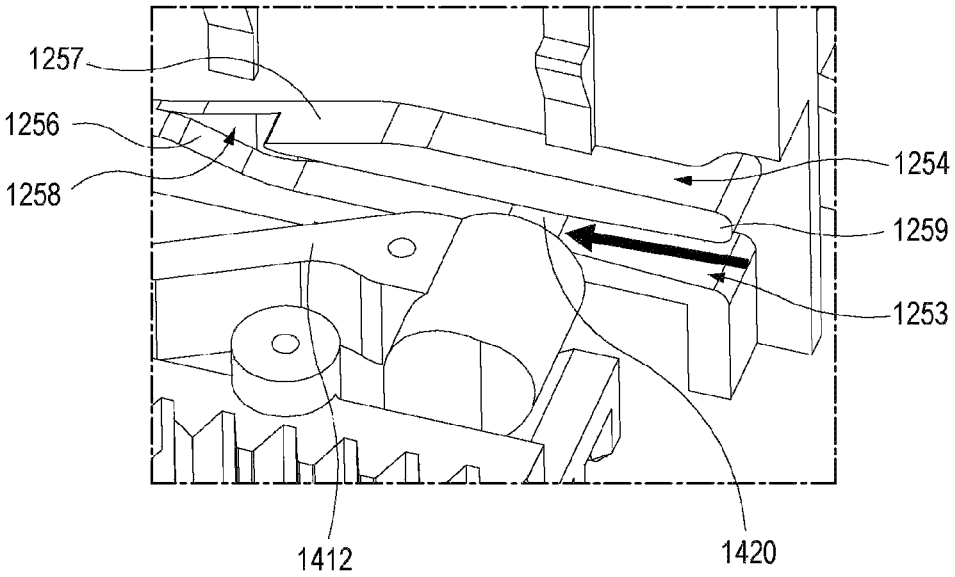
FIG. 22 is a perspective view showing an example where a lock pin of the third latch is moved from a latch unlocking position to a latch restricting position to restrict the first latch at the door locking position.
Figure 23:
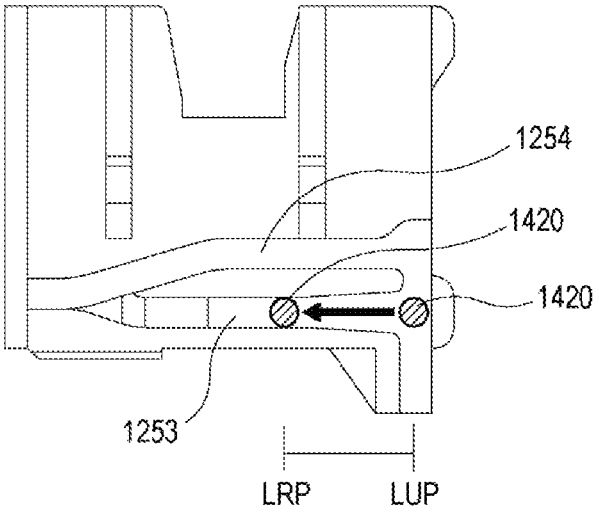
FIG. 23 is a top view of the retainer showing an example where the lock pin of the third latch is moved along a latch restricting groove from the latch unlocking position to the latch restricting position.
Figure 24:
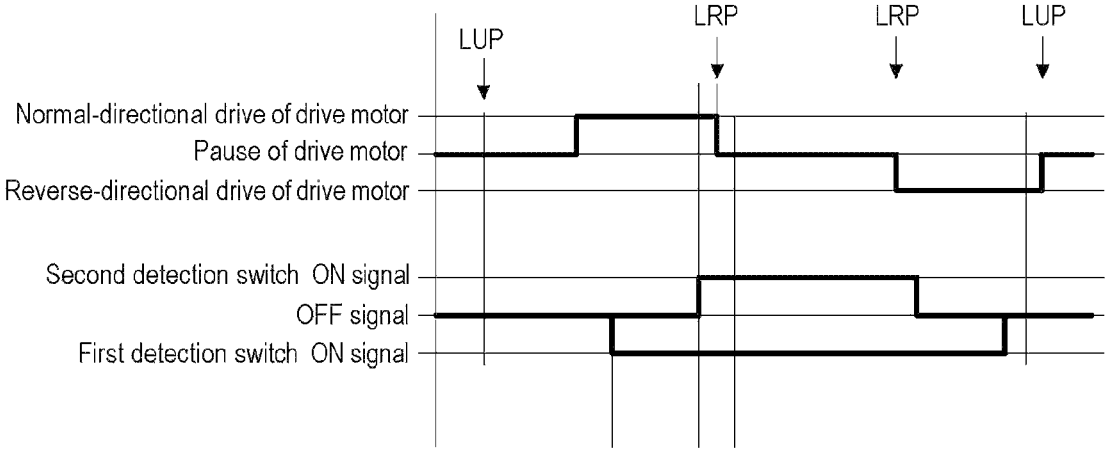
FIG. 24 is a signal chart showing signals applied to the drive motor and signals generated from the detector when the lock pin of the third latch is moved between the latch unlocking position and the latch restricting position.

Descriptions are made as to examples of the movement of the third latch 1400 from the latch unlocking position LUP to the latch restricting position LRP and the movement reverse thereto with reference to FIGS. 22 to 24.

When the first latch 1200 engaged with the door key 143 is at the door locking position DLP as being locked by the second latch 1300, the lock pin 1420 of the third latch 1400 is located at the latch unlocking position LUP. For example, at this state, the user puts the laundry into the washing tank 110 of the washing machine 100 and closes the sub-door 140 through a first one-time pressing. Of course, the sub-door 140 can be opened through the movement of the first latch 1200 to the door unlocking position DUP, which is caused by the user's second one-time pressing. If a washing operation starts after the user's manipulating the washing machine 100, electric power related to a normal-directional rotation is supplied from the controller 150 to the drive motor 1500. Then, the drive motor 1500 generates the normal-directional rotation, and, together with the normal-directional rotation, the lock pin 1420 of the third latch 1400 enters into the latch restricting groove 1253 of the pin groove 1250 from the latch unlocking position LUP.

While the lock pin 1420 of the third latch 1400 is moved to the latch restricting position LRP, the first switch activating portion 1414 of the slider 1410 is brought into contact with the first detection switch 1710 and the first detection switch 1710 generates an ON signal. Further, as the lock pin 1420 approaches the latch restricting position LRP, the second switch activating portion 1415 of the slider 1410 is brought into contact with the second detection switch 1720 and the second detection switch 1720 generates an ON signal. The controller 150 of the washing machine 100 receives the ON signals from both the first detection switch 1710 and the second detection switch 1720 and, thereafter, cuts off the electric power supply to the drive motor 1500 after about 0.1 sec to about 0.2 sec. Then, the drive motor 1500 is paused and the lock pin 1420 of the third latch 1400 is maintained at the latch restricting position LRP. At this time, as described above, the toothless section TLS2 of the rack gear 1430 enters into the toothless section TLS1 of the pinion gear 1622. Thus, the third latch 1400 is maintained at the latch restricting position LRP.

Since the lock pin 1420 is positioned in the latch restricting groove 1253 of the pin groove 1250 at the latch restricting position LRP of the third latch 1400, the first latch 1200 cannot be moved to the change position CP due to being caught by the lock pin 1420 and is restricted at the door locking position DLP by the lock pin 1420. Thus, although the user carelessly presses the sub-door 140 during the washing operation of the washing machine 100, the sub-door 140 of the washing machine 100 cannot be opened. This is because the first latch 1200 cannot be moved to the change position CP.

There may be a case where the user temporarily pauses the washing operation during the washing operation of the washing machine 100. If the temporary pause of the washing operation is inputted to the washing machine 100 by the user, the controller 150 of the washing machine 100 supplies electric power, which generates a reverse-directional rotation, to the drive motor 1500 for about one second. If the drive motor 1500 generates the reverse-directional rotation, the third latch 1400 and the lock pin 1420 are moved from the latch restricting position LRP to the latch unlocking position LUP. If the lock pin 1420 reaches the latch unlocking position LUP, the lock pin 1420 escapes from the pin groove 1250 and the first latch 1200 can be pressed toward the change position CP. Thus, if the user pauses the washing operation during the washing operation of the washing machine 100, the first latch 1200 is released from being restricted at the door locking position DLP of the first latch 1200 by the third latch 1400. Accordingly, the user can open the sub-door 140 of the washing machine 100 through a second one-time pressing.

After the washing operation is finished, the door lock device 1000 is capable of releasing locking of the door of the washing machine and pushing the door of the washing machine. An example of automatic door release of the door lock device 1000 is described with reference to FIGS. 25 to 30. The automatic door release shown in FIGS. 25 to 30 is achieved by providing the above-described first latch 1200, second latch 1300 and spring 1230 with the action of the third latch 1400.

Figure 25:
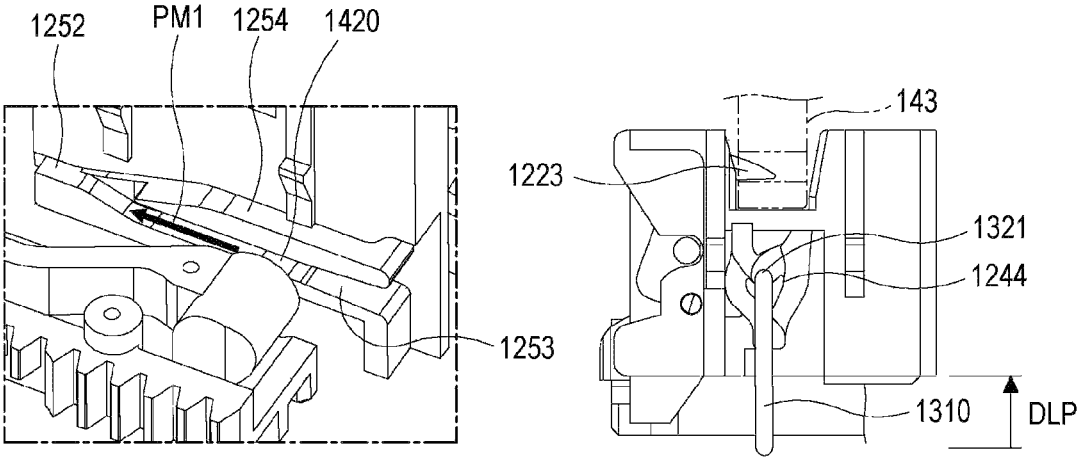
FIG. 25 shows an example of locking between the first latch and the third latch wherein the lock pin of the third latch is in the latch restricting position and the first latch is restricted at the door locking position by the third latch.

FIG. 25 shows the state where, during the washing operation, the lock pin 1420 of the third latch 1400 is at the latch restricting position LRP and the first latch 1200 is restricted at the door locking position DLP by the second latch 1300 and the lock pin 1420. If the washing operation of the washing machine 100 is finished, the controller 150 of the washing machine 100 supplies electric power to the drive motor 1500 for about one second such that the drive motor 1500 generates the normal-directional rotation. Then, due to the normal-directional rotation of the drive motor 1500, the lock pin 1420 of the third latch 1400 is moved along the latch restricting groove 1253 of the pin groove 1250 toward the opposite end 1252 of the pin groove 1250, i.e. toward the first latch moving position LMP1 (see an arrow PM1 in FIG. 25).

Figure 26:
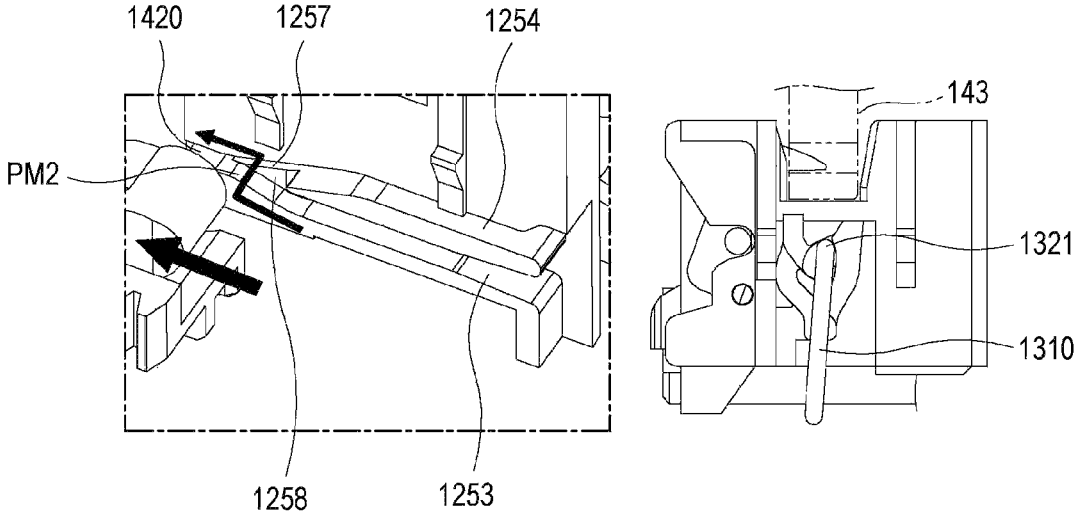
FIG. 26 shows an example of locking between the first latch and the third latch wherein the lock pin of the third latch is in a latch moving position and the first latch is slightly moved from the door locking position toward the change position.
Figure 30:
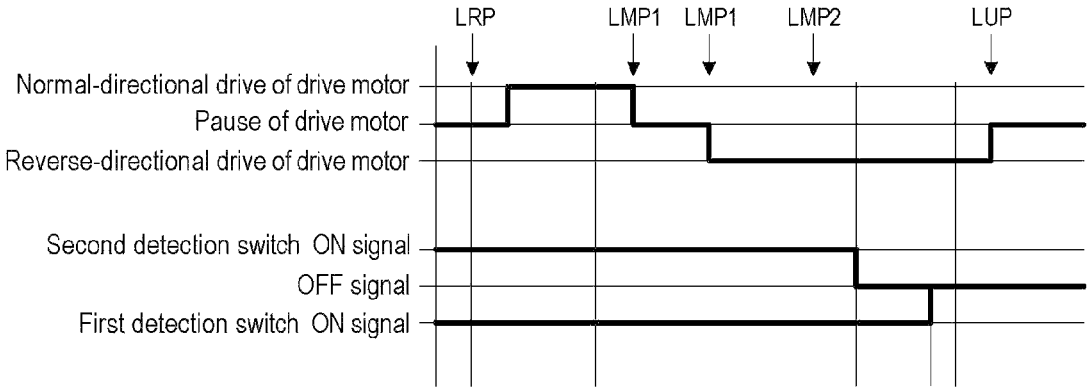
FIG. 30 is a signal chart showing signals applied to the drive motor and signals generated from the detector when the lock pin of the third latch is moved to the latch restrict position, the latch moving position and the latch unlocking position.

Referring to FIG. 26, while the lock pin 1420 is moved to the first latch moving position LMP1, the lock pin 1420 is displaced upward when passing the first inclined surface 1255 of the latch restricting groove 1253. Further, while the lock pin 1420 passes the second inclined surface 1256 of the latch restricting groove 1253, the first latch 1200 is slightly moved toward the change position CP against the force of the spring 1230 and the latch stopper 1244 of the first latch 1200 is separated from the first bent portion 1321 of the second latch 1300. This is because the lock pin 1420 is in contact with the second inclined surface 1256 and the force caused by the movement of the third latch 1400 acts on the second inclined surface 1256 in the rearward direction RD, under the state where the slider 1410 of the third latch 1400 is linearly moved in a direction perpendicular to the movement direction of the first latch 1200 and the lock pin 1420 of the third latch 1400 is linearly moved along the guide slit 1126 of the latch receptacle 1120. If the lock pin 1420 reaches the first latch moving position LMP1 as shown by an arrow PM2 of FIG. 26, the drive motor 1500 is paused as shown in FIG. 30. In the movement of the lock pin 1420 from the latch restricting position LRP to the first latch moving position LMP1, the controller 150 of the washing machine 100 supplies the electric power for the normal-direction rotation to the drive motor 1500 for about one second and cuts off the electric power supply. In this case, the first detection switch 1710 and the second detection switch 1720 continue to generate the ON signals. After the lock pin 1420 reaches the first latch moving position LMP1, the controller 150 of the washing machine 100 pauses the electric power supply to the drive motor 1500 for about one second. As shown in FIG. 26, while the lock pin 1420 is moved to the first latch moving position LMP1, the first bent portion 1321 of the second latch 1300 is separated from the latch stopper 1244 and the second latch 1300 unlocks the first latch 1200. Further, the first bent portion 1321 of the second latch 1300 is moved to the second front end 1243 of the latch groove 1240.

Figure 27:
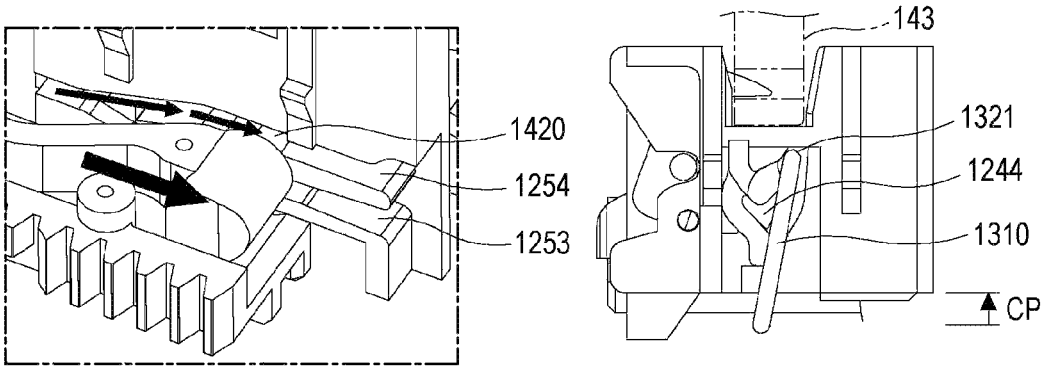
FIG. 27 shows an example of locking between the first latch and the third latch wherein the lock pin of the third latch is between the latch moving position and the latch unlocking position, and the first latch is moved to the door locking position.
Figure 28:
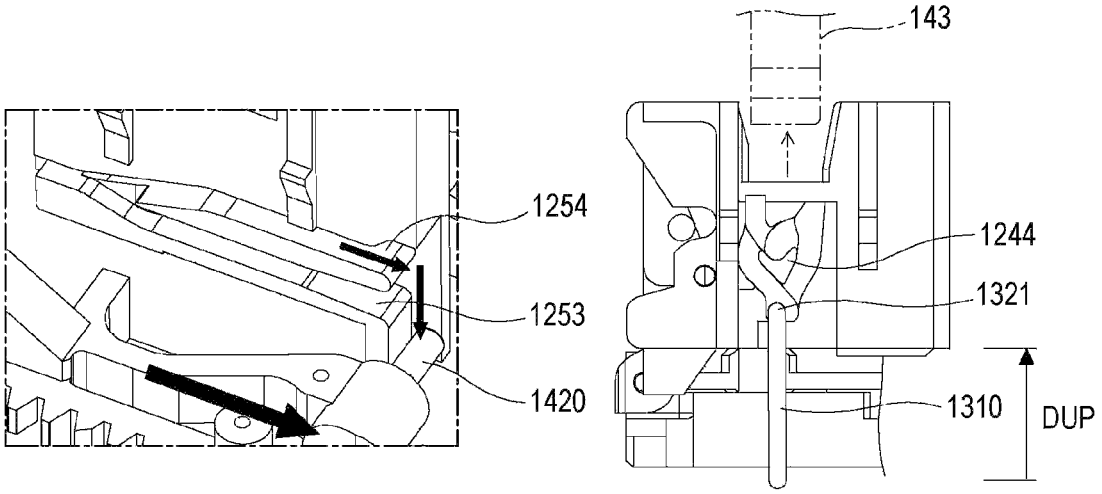
FIG. 28 shows an example where the lock pin of the third latch is in the latch unlocking position, and the first latch is unlocked from the second latch and is then moved to the door unlocking position.

Next, the controller 150 of the washing machine 100 supplies the electric power for the reverse-directional rotation to the drive motor 1500 for about two seconds. Then, as shown in FIGS. 27 and 28, the lock pin 1420 is moved from the first latch moving position LMP1 beyond the guide surface 1257 to the second latch moving position LMP2 along the latch moving groove 1254. Subsequently, the lock pin 1420 is moved from the second latch moving position LMP2 to the latch unlocking position LUP along the latch moving groove 1254. As shown in FIGS. 27 and 30, while the lock pin 1420 is moved from the first latch moving position LMP1 to the second latch moving position LMP2, and subsequently from the second latch moving position LMP2 to the latch unlocking position LUP, the second detection switch 1720 generates an OFF signal due to the contact release between the second detection switch 1720 and the second switch activating portion 1415, and then the first detection switch 1710 generates an OFF signal due to the contact release between the first detection switch 1710 and the first switch activating portion 1414. As shown in FIG. 27, due to the interaction between the lock pin 1420 and the guide surface 1257 inclined in the rearward direction RD, and due to the spacing distance between the latch restricting groove 1253 and the latch moving groove 1254, the first latch 1200 is further moved toward the change position CP against the force of the spring 1230 while the lock pin 1420 of the third latch 1400 passes the guide surface 1257. And, at the time when the lock pin 1420 passes over the end of the guide surface 1257, the first latch 1200 is positioned at the change position CP. In the movement of the third latch 1400 shown in FIGS. 25 to 27, the movement of the third latch 1400 is changed while the third latch 1400 is moved from the latch restricting position LRP through the first latch moving position LMP1 to the second latch moving position LMP2 by the drive motor 1500 and the latch drive mechanism 1600.

The lock pin 1420 reaches the one end 1251 of the latch moving groove 1254 and is separated from the latch moving groove 1254. And, at the same time, the first latch 1200 is unlocked from the third latch 1400 and becomes free. This is because the first bent portion 1321 of the second latch 1300 is already separated from the latch stopper 1244 and is positioned at the second front end 1243 of the latch groove 1240, and because the lock pin 1420 of the third latch 1400 does not restrict the first latch 1200 any more.

As shown in FIG. 28, the lock pin 1420 is separated from the pin groove 1250 and, at the same time, the first latch 1200 is moved toward the door unlocking position DUP by the spring 1230. At this time, the second latch 1300 is moved to the rear end 1241 of the latch groove 1240 along the right lateral surface 1244S2 of the latch stopper 1244. That is, similar to the above-described open process of the sub-door performed by the user's second one-time pressing, if the lock pin 1420 is moved from the second latch moving position LMP2 to the latch unlocking position LUP and is then separated from the latch moving groove 1254, the first latch 1200 is moved from the change position CP toward the door unlocking position DUP and the latch hook 1220 is disengaged from the engagement groove 144 of the door key 143. Further, due to the force of the spring 1230 which moves the first latch 1200 toward the door unlocking position DUP, a force pushing the sub-door 140 in the frontward direction FD is applied to the sub-door 140 through the first latch 1200 and therefore the sub-door 140 is automatically opened. That is, after the washing operation of the washing machine 100 is finished, the lock pin 1420 of the third latch 1400 is moved from the latch restricting position LRP to the first latch moving position LMP1 and thereafter is moved from the first latch moving position LMP1 to the latch unlocking position LUP. Together with the aforementioned movement of the lock pin 1420 of the third latch 1400, the first latch 1200 is moved from the door locking position DLP to the change position CP, thereafter to the door unlocking position DUP. Thus, after the washing operation of the washing machine 100 is finished, the door lock device 1000 is capable of releasing the lock between the sub-door 140 and the first latch 1200, and pushing the sub-door 140 in the frontward direction FD through the first latch 1200 biased by the spring 1230.

Figure 4:
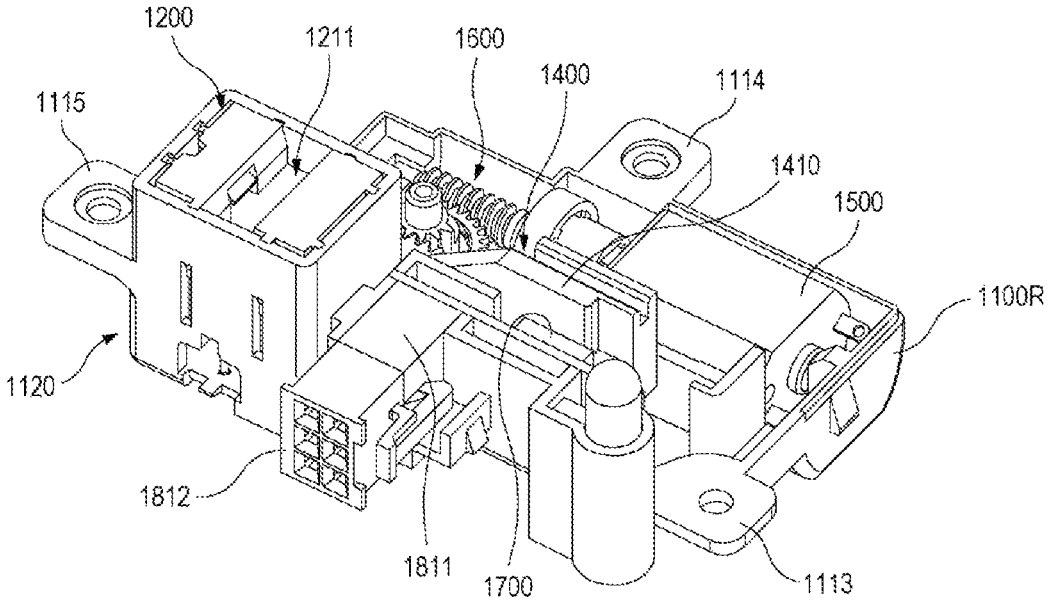
FIG. 4 is a perspective view of the door lock device with a front housing removed.
Figure 31:
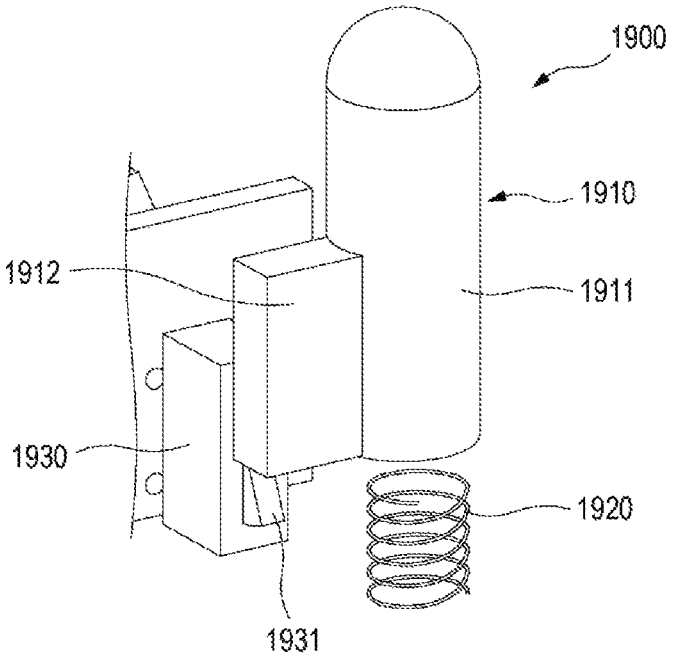
FIG. 31 is a perspective view showing a door switch.
Figure 32:
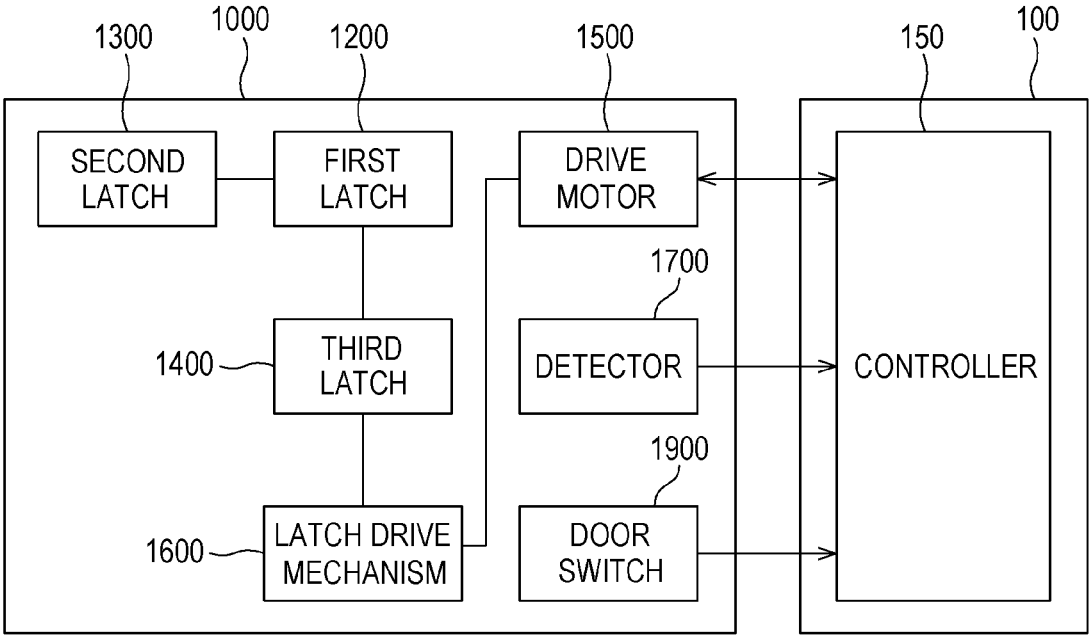
FIG. 32 is a block diagram showing a door lock device according to one embodiment and a controller of a washing machine.

The door lock device 1000 of one embodiment may include a switch which detects the closure of the sub-door 140. By way of example, as shown in FIGS. 4 and 31, a door switch 1900 is disposed in a switch receptacle 1130 of the housing 1100. The door switch 1900 includes: a cylindrical button 1910 movable in the frontward direction PD and the rearward direction RD and being guided by the switch receptacle 1130; a spring 1920 disposed between a rear end of the button 1910 and a closed end of the switch receptacle 1130 and always biasing the button 1910 in the frontward direction FD; and a detection switch 1930 generating an ON signal and an OFF signal in response to the button 1910 being pressed.

The button 1910 has a cylindrical pin 1911 and a pressing portion 1912 protruding laterally from the pin 1911. The detection switch 1930 has a lever 1931 which can be pressed by the pressing portion 1912. A front end portion of the pin 1911 protrudes in the front of the switch receptacle 1130 by about 9 mm. When the sub-door 140 of the washing machine 100 is closed, the sub-door 140 presses the front end portion of the pin 1911. Together with being pressed of the pin 1911, the pressing portion 1912 presses the lever 1931 and thus the detection switch 1930 generates an ON signal. The signal generated from the detection switch 1930 is transmitted to the controller 150 of the washing machine 100 through the connectors 1811 and 1812. The detection switch 1930 is situated in the switch receptacle 1130 such that the detection switch 1930 generates the ON signal when the pin 1911 is pressed by about 2 mm.

Figure 33:
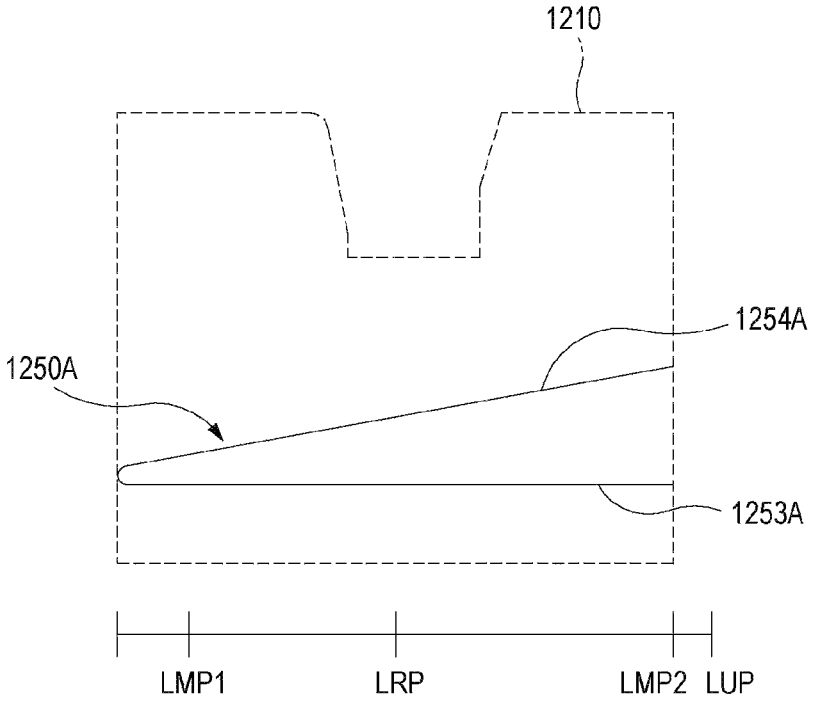
FIG. 33 is a diagram schematically showing another example of a pin groove.
Figure 34:
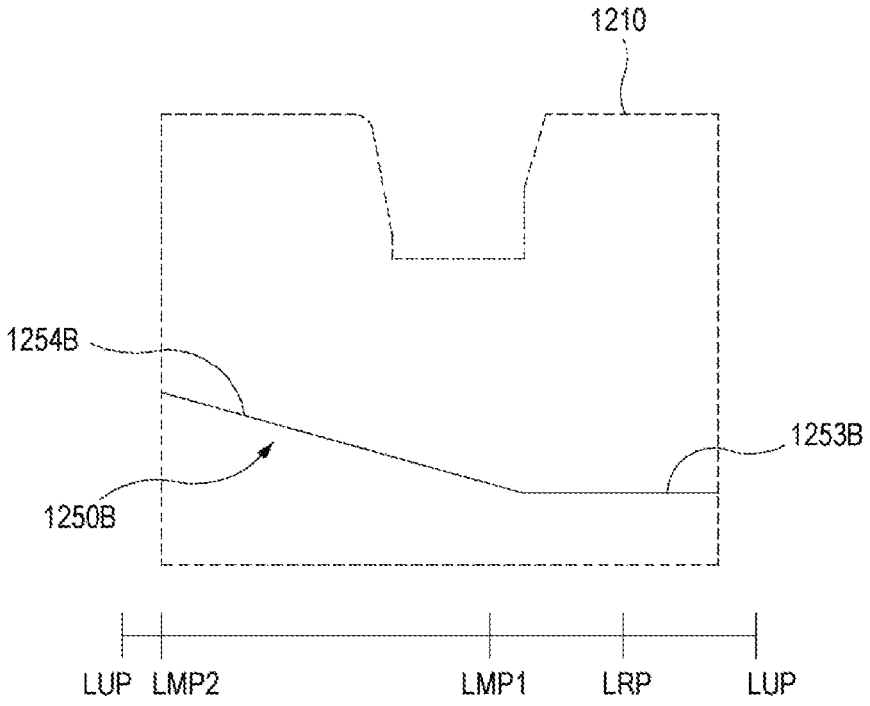
FIG. 34 is a diagram schematically showing a further example of a pin groove.

FIGS. 33 and 34 schematically show variation examples of the above-described pin groove 1250. A pin groove 1250A shown in FIG. 33 has a latch restricting groove 1253A and a latch moving groove 1254A which are linear. The latch restricting groove 1253A extends in a direction perpendicular to the movement directions of the first latch 1200 between left and right ends of the retainer 1210. The latch moving groove 1254A extends from the latch restricting groove 1253A and is inclined with respect to the latch restricting groove 1253A. A pin groove 1250B shown in FIG. 34 has a latch restricting groove 1253B and a latch moving groove 1254B which are linear. The latch restricting groove 1253B extends from the left end of the retainer 1210 in a direction perpendicular to the movement directions of the first latch 1200. The latch moving groove 1254B extends from an end of the latch restricting groove 1253B and is inclined with respect to the latch restricting groove 1253B. The latch moving groove 1254A and the latch moving groove 1254B may be curved with a predetermined curvature.

Figure 35:
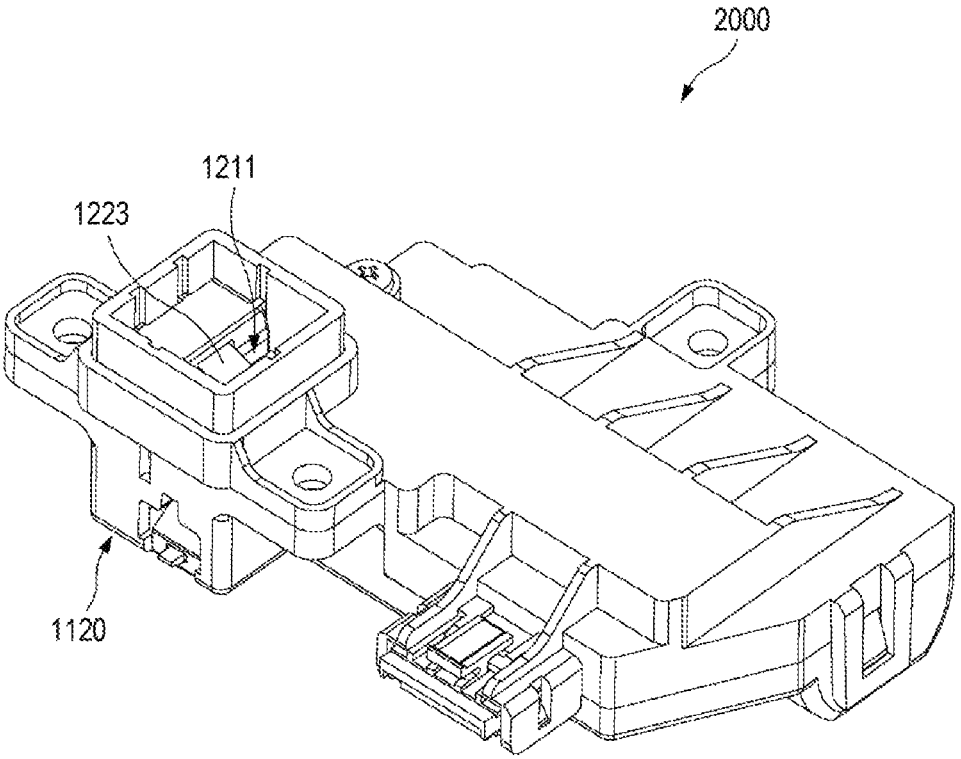
FIG. 35 is a perspective view showing a door lock device according to another embodiment.

The door lock device 1000 according to another embodiment may not include the above-described door switch 1900. FIG. 35 shows a door lock device of such an example. A door lock device 2000 shown in FIG. 35 has a configuration similar to the configuration of the door lock device 1000 according to the above-described embodiment except the door switch 1900.

Figure 29:
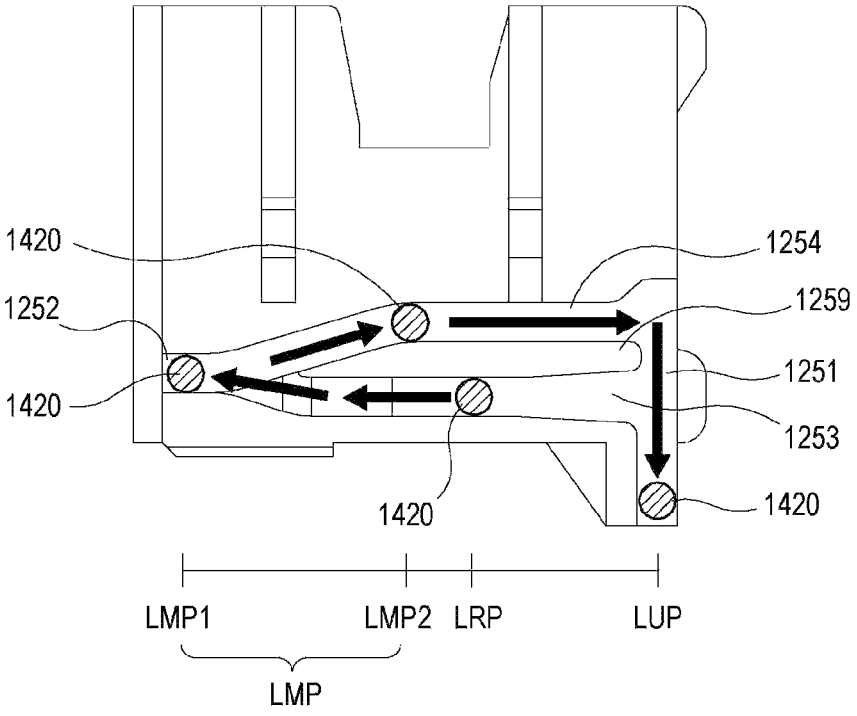
FIG. 29 is a top view of the retainer, showing that the lock pin is moved from the latch restricting position to the latch moving position, and is then moved from the latch moving position to the latch unlocking position.

Regarding the descriptions of the foregoing embodiments, each position of the third latch 1400 is shown as a point in FIGS. 23 and 29. However, to show the position as a point is only illustrative. It is to be appreciated that the first latch 1200 is restricted in one section of the movement path of the third latch 1400 and the first latch 1200 is pushed in another section of the movement path of the third latch 1400. Thus, as long as the third latch 1400 accomplishes the desired function for the first latch 1200 in said one section and said another section, the latch restricting position LRP of the third latch 1400 may be a specific position in said one section and the latch moving position LMP of the third latch 1400 may be a specific position in said another section.

In the door lock device 1000 of the foregoing embodiment, the first latch 1200 includes the pin groove 1250 and the third latch 1400 includes the lock pin 1420 inserted to the pin groove 1250. In the door lock device according to some embodiments, the lock pin 1420 may be provided at the first latch 1200 and the pin groove 1250 may be provided at the third latch 1400. In such an embodiment, by virtue of the drive motor 1500 and the latch drive mechanism 1600, the third latch 1400 formed with the pin groove 1250 may be driven to the latch unlocking position, the latch restricting position and the latch moving position with respect to the first latch 1200 in a direction different from the movement direction of the first latch 1200 (e.g., in a direction perpendicular to the movement direction of the first latch 1200).

The detector 1700 of the door lock device 1000 according to the foregoing embodiment includes the first detection switch 1710 and the second detection switch 1720. However, the detector 1700 of the door lock device according to some embodiments may include a single detection switch.

The latch drive mechanism 1600 of the door lock device 1000 according to the foregoing embodiment is a gear transmission mechanism using gears. The latch drive mechanism of the door lock device according to some embodiments may include a cam mechanism, a slide mechanism, a crank mechanism and the like which are capable of converting the rotation motion generated by the drive motor 1500 into the linear reciprocal motion of the third latch 1400.

The first latch 1200 of the door lock device 1000 according to the foregoing embodiment includes the hook-shaped latch hook 1220 having a hook shape. The first latch of the door lock device according to some embodiments may engage with the door key 143 by means of a pair of latch hooks, one or a pair of pins, or a plurality of finger-shaped parts.

The present disclosure described heretofore should not be limited to the above-described embodiments and the examples shown in the accompanying drawings. It will be apparent to those of ordinary skill in the technical field to which the present disclosure pertains, that various substitutions, modifications and alternations may be made without departing from the technical idea of the present disclosure.

What is claimed is:

1. A door lock device for releasably locking a door of a washing machine, comprising:

a housing;

a first latch coupled to the housing to be movable in frontward and rearward directions, the first latch being movable to a door unlocking position where the first latch unlocks the door, a change position located rearward from the door unlocking position, and a door locking position where the first latch locks the door, the door locking position being located between the door unlocking position and the change position;

a spring disposed in the housing and biasing the first latch toward the door unlocking position;

a second latch releasably locking the first latch at the door locking position;

a third latch movably disposed in the housing and releasably locking the first latch, the third latch restricting the first latch at the door locking position and unlocking the first latch after pushing the first latch against the spring from the door locking position to the change position;

a drive motor disposed in the housing and driving the third latch; and a latch drive mechanism operably coupled to the drive motor and moving the third latch, wherein the drive motor and the latch drive mechanism move the third latch to a latch unlocking position where the first latch is unlocked, a latch restricting position where the first latch is restricted at the door locking position, and a latch moving position where the first latch is pushed against the spring from the door locking position toward the change position, wherein the third latch includes a lock pin and the first latch includes a pin groove into which the lock pin is inserted, wherein a movement of the third latch pushes the first latch toward the change position through contact between the lock pin and the pin groove, wherein the housing includes a guide slit extending obliquely with respect to a movement direction of the first latch, and wherein the lock pin is inserted into the pin groove through the guide slit.

2. The door lock device of claim 1, wherein the latch unlocking position, the latch restricting position, and the latch moving position are located in-line, and wherein the drive motor and the latch drive mechanism change the movement of the third latch between the latch restricting position and the latch moving position.

3. The door lock device of claim 2, wherein the latch moving position comprises a first latch moving position where the third latch moves the first latch from the door locking position toward the change position and a second latch moving position where the third latch positions the first latch to the change position.

4. The door lock device of claim 3, wherein the second latch moving position is located between the first latch moving position and the latch unlocking position.

5. The door lock device of claim 1, further comprising at least one detection switch for detecting the movement of the third latch toward the latch restricting position, wherein the third latch includes a switch activating portion which makes contact with the detection switch and activates the detection switch.

6. The door lock device of claim 1, wherein the pin groove includes a latch restricting groove and a latch moving groove which extends from the latch restricting groove and is inclined with respect to the latch restricting groove, wherein the lock pin is positioned at the latch restricting groove, restricting the first latch at the door locking position, and wherein the lock pin is moved along at least a portion of the latch moving groove, pushing the first latch toward the change position.

7. The door lock device of claim 6, wherein the pin groove includes a guide surface guiding the lock pin from the latch restricting groove to the latch moving groove.

8. The door lock device of claim 6, wherein the latch restricting groove extends perpendicularly to the movement direction of the first latch.

9. The door lock device of claim 6, wherein the pin groove V-shaped or U-shaped.

10. A door lock device for releasably locking a door of a washing machine, comprising:

a housing;

a first latch coupled to the housing to be movable in frontward and rearward directions, the first latch being movable to a door unlocking position where the first latch unlocks the door, a change position located rearward from the door unlocking position, and a door locking position where the first latch locks the door, the door locking position being located between the door unlocking position and the change position;

a spring disposed in the housing and biasing the first latch toward the door unlocking position;

a second latch releasably locking the first latch at the door locking position;

a third latch movably disposed in the housing and releasably locking the first latch, the third latch restricting the first latch at the door locking position and unlocking the first latch after pushing the first latch against the spring from the door locking position to the change position;

a drive motor disposed in the housing and driving the third latch; and a latch drive mechanism operably coupled to the drive motor and moving the third latch, wherein the drive motor and the latch drive mechanism move the third latch to a latch unlocking position where the first latch is unlocked, a latch restricting position where the first latch is restricted at the door locking position, and a latch moving position where the first latch is pushed against the spring from the door locking position toward the change position, wherein the third latch includes a lock pin and the first latch includes a pin groove into which the lock pin is inserted, wherein a movement of the third latch pushes the first latch toward the change position through contact between the lock pin and the pin groove, wherein the third latch comprises a slider coupled to the housing to be obliquely slidable with respect to a movement direction of the first latch, and a rack gear coupled to the slider, wherein the lock pin is coupled to the slider, and wherein the latch drive mechanism comprises at least one pinion gear which is meshed with the rack gear and moves the third latch.

11. The door lock device of claim 10, wherein the pinion gear includes a toothless section in a portion of a perimeter and a stopper in the toothless section, wherein the rack gear includes a toothless section which enters into the toothless section of the pinion gear at the latch restricting position, and wherein the stopper is positioned at the toothless section of the rack gear, fixing the slider at the latch restricting position.

12. The door lock device of claim 11, wherein a gear tooth of the rack gear in the toothless section of the rack gear has a thickness at which the gear tooth does not make contact with the stopper, and wherein gear teeth of the rack gear located at both ends of the toothless section of the rack gear make contact with the stopper.

13. The door lock device of claim 10, wherein the slider includes an arm biasing the lock pin toward the pin groove.

* * * * *